US009752100B2

(12) United States Patent
Warkotsch et al.

(10) Patent No.: US 9,752,100 B2
(45) **Date of Patent: *Sep. 5, 2017**

(54) DETERGENTS

(75) Inventors: Nadine Warkotsch, Duesseldorf (DE); Johannes Zipfel, Duesseldorf (DE); Arnd Kessler, Monheim (DE); Christian Nitsch, Duesseldorf (DE); Arno Dueffels, Duesseldorf (DE); Thomas Holderbaum, Hilden (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 0 days.

This patent is subject to a terminal disclaimer.

(21) Appl. No.: 12/535,991

(22) Filed: Aug. 5, 2009

(65) Prior Publication Data

US 2010/0041575 A1 Feb. 18, 2010

Related U.S. Application Data

(63) Continuation of application No. PCT/EP2007/063326, filed on Dec. 5, 2007.

(30) Foreign Application Priority Data

Feb. 6, 2007 (DE) ..... 10 2007 006 628

(51) Int. Cl.

| | |
|---|---|
| ***C11D 1/72*** | (2006.01) |
| ***C11D 1/722*** | (2006.01) |
| ***C11D 3/395*** | (2006.01) |
| ***C11D 3/37*** | (2006.01) |
| ***C11D 3/33*** | (2006.01) |
| ***C11D 3/075*** | (2006.01) |
| ***C11D 3/39*** | (2006.01) |
| ***C11D 3/04*** | (2006.01) |
| ***C11D 3/36*** | (2006.01) |

(52) U.S. Cl.

CPC ..... *C11D 3/33* (2013.01); *C11D 1/72* (2013.01); *C11D 1/722* (2013.01); *C11D 3/042* (2013.01); *C11D 3/075* (2013.01); *C11D 3/361* (2013.01); *C11D 3/378* (2013.01); *C11D 3/3757* (2013.01); *C11D 3/3902* (2013.01); *C11D 3/3942* (2013.01)

(58) Field of Classification Search

CPC ..... C11D 1/72; C11D 1/722; C11D 3/042; C11D 3/075; C11D 3/33; C11D 3/361; C11D 3/3757; C11D 3/378; C11D 3/3902; C11D 3/3942

USPC ..... 510/220, 221, 224, 226, 228, 372, 376, 510/475, 495, 496, 499

See application file for complete search history.

(56) References Cited

U.S. PATENT DOCUMENTS

| | | | | |
|---|---|---|---|---|
| 3,519,570 | A | 7/1970 | McCarty | |
| 4,740,469 | A | 4/1988 | Nishinaka et al. | |
| 5,279,756 | A | 1/1994 | Savio et al. | |
| 5,308,532 | A | 5/1994 | Adler et al. | |
| 5,547,612 | A | 8/1996 | Austin | |
| 5,691,293 | A | 11/1997 | Kruse et al. | |
| 5,998,346 | A | 12/1999 | Welch | |
| 6,119,705 | A * | 9/2000 | Getty et al. | 134/25.2 |
| 6,162,259 | A | 12/2000 | Williams (nee Mac Beath) | |
| 6,210,600 | B1 | 4/2001 | Zhou et al. | |
| 6,326,345 | B1 * | 12/2001 | Mondin | 510/365 |
| 6,350,728 | B1 | 2/2002 | Paatz et al. | |
| 6,589,925 | B1 * | 7/2003 | Binstock | C11D 17/0078 510/141 |
| 6,693,065 | B2 * | 2/2004 | Gentilhomme et al. | 510/108 |
| 6,835,703 | B1 * | 12/2004 | Cho et al. | 510/221 |
| 6,962,898 | B2 * | 11/2005 | Kessler et al. | 510/223 |
| 7,205,266 | B2 * | 4/2007 | Holderbaum et al. | 510/224 |
| 7,557,074 | B2 | 7/2009 | Becker et al. | |
| 7,879,154 | B2 * | 2/2011 | Warkotsch et al. | 134/25.2 |
| 2002/0082186 | A1 * | 6/2002 | Smith | C11D 17/0073 510/446 |
| 2002/0173441 | A1 | 11/2002 | De Lima et al. | |
| 2002/0187907 | A1 * | 12/2002 | Mente | C11D 1/721 510/220 |
| 2003/0158064 | A1 | 8/2003 | Kessler | |
| 2004/0058846 | A1 * | 3/2004 | Kistenmacher et al. | 510/475 |
| 2004/0058847 | A1 | 3/2004 | Morschhauser et al. | |
| 2004/0072716 | A1 | 4/2004 | Kistenmacher et al. | |
| 2004/0116319 | A1 * | 6/2004 | Nitsch et al. | 510/475 |

(Continued)

FOREIGN PATENT DOCUMENTS

| | | | |
|---|---|---|---|
| CA | 2660193 | A1 | 2/1980 |
| CA | 2145663 | A1 | 4/1994 |

(Continued)

OTHER PUBLICATIONS

B. Potthoff-Karl et al., "Synthese abbaubarer Komplexbildner und ihre Anwendung in Waschmittel- und Reinigerformulierungen," *SÖFW—Journal Seifen, Oele, Fette, Wachse*, vol. 122, No. 6, May 1996, pp. 392-394, 396.

Co-pending U.S. Appl. No. 12/536,885, filed Aug. 6, 2009.

Co-pending U.S. Appl. No. 12/535,927, filed Aug. 5, 2009.

Co-pending U.S. Appl. No. 12/535,956, filed Aug. 5, 2009.

Co-pending U.S. Appl. No. 12/536,879, filed Aug. 6, 2009.

International Search Report of PCT/EP2007/063326, dated Mar. 14, 2008.

Office Action dated Mar. 10, 2010, from co-pending U.S. Appl. No. 12/535,956.

(Continued)

*Primary Examiner* — Gregory R Delcotto

(74) *Attorney, Agent, or Firm* — RatnerPrestia

(57) ABSTRACT

Phosphate-free dishwasher detergents which contain a builder, bleaching agents, a nonionic surfactant, and also a) a copolymer comprising i) sulfonic acid group-containing monomers, ii) further ionic and/or nonionic monomers, b) methyl glycine diacetic acid. The detergents according to the invention have good cleaning and rinsing results which are comparable to those of phosphate-containing dishwasher detergents or even outdo them.

30 Claims, No Drawings

(56) References Cited

U.S. PATENT DOCUMENTS

| | | | |
|---|---|---|---|
| 2005/0049165 | A1 | 3/2005 | Kottwitz et al. |
| 2005/0261156 | A1 | 11/2005 | Kottwitz et al. |
| 2005/0261158 | A1 | 11/2005 | Kottwitz et al. |
| 2007/0010417 | A1 | 1/2007 | Wieland et al. |
| 2007/0128129 | A1 | 6/2007 | Stehr et al. |
| 2007/0185001 | A1 | 8/2007 | Baur et al. |
| 2008/0045436 | A1 | 2/2008 | Zimmermann |
| 2008/0193999 | A1 | 8/2008 | Andersen et al. |
| 2009/0264332 | A1 | 10/2009 | Yoshikawa |
| 2010/0035060 | A1 | 2/2010 | Leininger |
| 2010/0160203 | A1 | 6/2010 | Seebeck |

FOREIGN PATENT DOCUMENTS

| | | | |
|---|---|---|---|
| CA | 2166277 | | 1/1995 |
| CA | 2258218 | A1 | 12/1997 |
| DE | 196 51 446 | A1 | 6/1998 |
| DE | 10032612 | A1 | 2/2002 |
| DE | 10050622 | A1 | 5/2002 |
| DE | 101 04 470 | A1 | 8/2002 |
| DE | 10309803 | | 9/2004 |
| DE | 103 60 841 | A1 | 7/2005 |
| DE | 10309803 | B4 | 7/2007 |
| EP | 0 445 852 | A1 | 9/1991 |
| EP | 0 458 397 | B1 | 11/1991 |
| EP | 0 458 398 | B1 | 11/1991 |
| EP | 0 530 870 | B1 | 3/1993 |
| EP | 0 544 440 | A2 | 6/1993 |
| EP | 0 551 670 | A1 | 7/1993 |
| EP | 0 662 117 | B1 | 7/1995 |
| EP | 0 692 020 | B1 | 1/1996 |
| EP | 0 906 407 | B1 | 4/1999 |
| EP | 1 113 070 | A2 | 7/2001 |
| EP | 1 400 583 | A1 | 3/2004 |
| EP | 1 721 962 | A1 | 11/2006 |
| GB | 1 214 234 | | 12/1970 |
| GB | 1 300 596 | | 12/1972 |
| GB | 2 390 098 | A | 12/2003 |
| WO | WO 92/21760 | A1 | 12/1992 |
| WO | 9500624 | | 1/1995 |
| WO | WO 95/06710 | A1 | 3/1995 |
| WO | WO 96/00277 | A1 | 1/1996 |
| WO | WO 97/49792 | A1 | 12/1997 |
| WO | WO 00/63336 | A1 | 10/2000 |
| WO | 0220708 | | 3/2002 |
| WO | WO 03/014358 | A2 | 2/2003 |
| WO | WO 2005/063974 | A1 | 7/2005 |
| WO | WO 2005/090541 | A1 | 9/2005 |
| WO | WO 2005/108537 | A1 | 11/2005 |
| WO | WO 2005/108540 | A1 | 11/2005 |
| WO | WO 2005/124012 | A1 | 12/2005 |
| WO | WO 2006/002643 | A2 | 1/2006 |
| WO | WO 2006/029806 | A1 | 3/2006 |
| WO | WO 2006/106332 | A1 | 10/2006 |
| WO | WO 2007/052064 | A1 | 5/2007 |
| WO | WO 2008/017620 | A1 | 2/2008 |
| WO | 2008028896 | | 3/2008 |

OTHER PUBLICATIONS

W. W. Bertleff, "New Chelating Agents for the Detergent and Cleaning Industry," *New Horizons an AOCS/CSMA Detergent Industry Conference*, Chapter 10, pp. 97-112 (2002).

Notice of Allowance issued for Application No. 12/535,927 dated Aug. 1, 2012.

Acusol™ 587 Calcium Polyphosphate Inhibitor for Detergents, Rohm & Haas (May 2004).

Acusol™ 588 Polyphosphate and Silicate Scale Inhibitor for Laundry and Automatic Dishwashing Detergents, Rohm & Haas (Aug. 2004).

Karl et al., XP 000587160, Complexing Agents, 6 pages.

Amendment filed May 11, 2011, in response to an Office Action dated Jan. 11, 2011, issued in related U.S. Appl. No. 12/535,927.

Amendment filed on Jul. 9, 2010, responding to an Office Action dated Mar. 10, 2010, from co-pending U.S. Appl. No. 12/535,956.

Amendment filed on Nov. 10, 2010, responding to an Office Action dated Aug. 10, 2010, from co-pending U.S. Appl. No. 12/536,885.

Corrected Notice of Allowance, Notice of Allowability dated Jan. 5, 2011, from co-pending U.S. Appl. No. 12/536,885.

International Search Report of PCT/EP2007/059203, dated Apr. 7, 2008.

International Search Report of PCT/EP2007/061753, dated Aug. 26, 2008.

International Search Report of PCT/EP2007/063327, dated Aug. 26, 2008.

International Search Report of PCT/EP2007/063328, dated Apr. 11, 2008.

International Search Report of PCT/EP2007/063331, dated May 20, 2008.

Notice of Allowance, Notice of Allowability dated Dec. 3, 2010, from co-pending U.S. Appl. No. 12/536,885.

Notice of Allowance, Notice of Allowability dated Sep. 20, 2010, from co-pending U.S. Appl. No. 12/535,956.

Office Action dated Aug. 10, 2010, from co-pending U.S. Appl. No. 12/536,885.

Office Action dated Feb. 18, 2011, from co-pending U.S. Appl. No. 12/536,885.

Office Action dated Jun. 28, 2011, from co-pending U.S. Appl. No. 12/535,927.

Withdrawal from Issue dated Feb. 1, 2011, from co-pending U.S. Appl. No. 12/536,885.

BASF, "Safety Data Sheet Trilon M Powder," Aug. 15, 2104, pp. 1-10.

BASF, "Trilon M Types," Technology Information, May 2007, pp. 1-14.

BASF, "Trilon M flussig," Technische Information, Apr. 1998, pp. 1-20.

* cited by examiner

DETERGENTS

CROSS-REFERENCE TO RELATED APPLICATIONS

This application is a continuation under 35 U.S.C. §§120 and 365(c) of International Application PCT/EP2007/063326, filed Dec. 5, 2007. This application also claims priority under 35 U.S.C. §119 of DE 10 2007 006 628.9, filed Feb. 6, 2007. The disclosures of PCT/EP2007/063326 and DE 10 2007 006 628.9 are incorporated herein by reference in their entirety.

BACKGROUND OF THE INVENTION

The present patent application describes detergents, in particular detergents for the machine dishwashing. The present application in particular provides phosphate-free machine dishwashing detergents.

More stringent requirements are today often applied to machine washed dishes than are applied to hand washed dishes. For instance, after machine washing, dishes should not only be completely free of food residues but should for example also not exhibit any whitish blemishes based on water hardness or other mineral salts which originate from dried water drops due to a lack of wetting agents.

Modern machine dishwashing detergents satisfy these requirements by incorporating cleaning, conditioning, water softening and rinsing active ingredients and are for example known to the consumer as "2-in-1" or "3-in-1" dishwashing detergents. Machine dishwashing detergents intended for private consumers contain builders as an essential component for successful washing and rinsing. On the one hand, these builders increase the alkalinity of the washing liquor, fats and oils being emulsified and saponified as alkalinity rises, and, on the other hand, reduce the water hardness of the washing liquor by complexing the calcium ions present in the aqueous liquor. Alkali metal phosphates have proved to be particularly effective builders, for which reason they form the main ingredient of the majority of commercially obtainable machine dishwashing detergents.

While phosphates are thus very highly regarded in terms of their advantageous action as a component of machine dishwashing detergents, their use is, however, not entirely unproblematic from an environmental protection standpoint since a significant proportion of the phosphate passes with domestic wastewater into bodies of water and, especially in standing bodies of water (lakes, dams), plays a considerable part in their eutrophication or overfertilization. As a consequence of this phenomenon, the use of pentasodium triphosphate in textile detergents has been considerably reduced by statutory regulations in quite a number of countries, for example the USA, Canada, Italy, Sweden, Norway, and has been entirely prohibited in Switzerland. In Germany, since 1984, the permitted maximum content of this builder in laundry detergents has been 20%.

In addition to nitrilotriacetic acid, sodium aluminum silicates (zeolites) are primarily used as phosphate replacements or substitutes in textile detergents. However, for various reasons, these substances are not suitable for use in machine dishwashing detergents. A series of replacements have accordingly been discussed in the literature as alternatives to alkali metal phosphates in machine dishwashing detergents, among which citrates are of particular significance.

European patents EP 662 117 B1 (Henkel KGaA) and EP 692 020 B1 (Henkel KGaA), for example, describe phosphate-free machine dishwashing detergents which, in addition to a citrate, furthermore contain carbonates, bleaching agents and enzymes.

A further alternative to alkali metal phosphates, which as sole builder is however preferably used in combination with citrates, is methylglycinediacetic acid (MGDA). European patent EP 906 407 B1 (Reckitt Benckiser) or European patent application EP 1 113 070 A2 (Reckitt Benckiser), for example, describe MGDA-containing machine dishwashing detergents.

Despite the efforts so far made, manufacturers of machine dishwashing detergents have not hitherto managed to provide phosphate-free machine dishwashing detergents which are comparable to or even surpass phosphate-containing detergents with regard to their washing and rinsing performance. Such equality of performance is, however, a prerequisite for the successful market introduction of phosphate-free detergents, since the majority of end consumers, despite the widespread public discussion of environmental issues, will always decide against an environmentally advantageous product if this product is not in line with the market standard in terms of price and/or performance.

DESCRIPTION OF THE INVENTION

In the light of this background situation, the object of the present application is to provide a phosphate-free automatic dishwashing agent which is comparable with or even surpasses conventional phosphate-containing detergents both in terms of its cleaning performance and in terms of its rinsing results and its performance in terms of film deposition inhibition.

It has been found that machine dishwashing detergents which, in addition to copolymers containing sulfonic acid groups, also contain methylglycinediacetic acid, exhibit excellent washing and rinsing performance without the addition of alkali metal phosphates.

The present application accordingly firstly provides a phosphate-free automatic dishwashing agent which contains builder, bleaching agent, nonionic surfactant, and furthermore a) copolymer comprising
   i) monomers containing sulfonic acid groups
   ii) further ionic and/or nonionic monomers
b) methylglycinediacetic acid.

A first characterizing component of preparations according to the invention comprises the copolymers a) containing sulfonic acid groups which, apart from a monomer containing sulfonic acid groups, comprise at least one further ionic or nonionic monomer. The copolymers a) may comprise two, three, four or more different monomer units.

Preferred monomers containing sulfonic acid groups are those of the formula $$R^5(R^6)C{=}C(R^7){-}X{-}SO_3H$$

in which $R^5$ to $R^7$ mutually independently denote —H, —$CH_3$, a straight-chain or branched saturated alkyl residue with 2 to 12 carbon atoms, a straight-chain or branched, mono- or polyunsaturated alkenyl residue with 2 to 12 carbon atoms, alkyl or alkenyl residues substituted with —$NH_2$, —OH or —COOH, or denote —COOH or —$COOR^4$, $R^4$ being a saturated or unsaturated, straight-chain or branched hydrocarbon residue with 1 to 12 carbon atoms, and X denotes an optionally present spacer group which is selected from —$(CH_2)_n$— with n=0 to 4, —COO—$(CH_2)_k$— with k=1 to 6, —C(O)—NH—$C(CH_3)_2$— and —C(O)—NH—$CH(CH_2CH_3)$—.

Preferred among these monomers are those of the formulae $H_2C{=}CH{-}X{-}SO_3H$ $H_2C{=}C(CH_3){-}X{-}SO_3H$ $HO_3S{-}X{-}(R^6)C{=}C(R^7){-}X{-}SO_3H$, in which $R^6$ and $R^7$ are mutually independently selected from —H, —$CH_3$, —$CH_2CH_3$, —$CH_2CH_2CH_3$, —$CH(CH_3)_2$ and X denotes an optionally present spacer group which is selected from —$(CH_2)_n$— with n=0 to 4, —COO—$(CH_2)_k$— with k=1 to 6, —C(O)—NH—$C(CH_3)_2$— and —C(O)—NH—$CH(CH_2CH_3)$—.

Particularly preferred monomers containing sulfonic acid groups are here 1-acrylamido-1-propanesulfonic acid, 2-acrylamido-2-propanesulfonic acid, 2-acrylamido-2-methyl-1-propanesulfonic acid, 2-methacrylamido-2-methyl-1-propanesulfonic acid, 3-methacrylamido-2-hydroxypropanesulfonic acid, allylsulfonic acid, methallylsulfonic acid, allyloxybenzenesulfonic acid, methallyloxybenzenesulfonic acid, 2-hydroxy-3-(2-propenyloxy) propanesulfonic acid, 2-methyl-2-propene-1-sulfonic acid, styrenesulfonic acid, vinylsulfonic acid, 3-sulfopropyl acrylate, 3-sulfopropyl methacrylate, sulfomethacrylamide, sulfomethylmethacrylamide and mixtures of the stated acids or the water-soluble salts thereof.

The sulfonic acid groups may be present in the polymers entirely or in part in neutralized form, i.e. the acidic hydrogen atom of the sulfonic acid group may be replaced in some or all of the sulfonic acid groups with metal ions, preferably alkali metal ions and in particular with sodium ions. It is preferred according to the invention to use copolymers containing partially or completely neutralized sulfonic acid groups.

In those copolymers solely containing monomers from groups i) and ii), the monomer distribution of the copolymers preferably used according to the invention preferably amounts in each case to 5 to 95 wt. % of i) or ii), particularly preferably 50 to 90 wt. % of monomer from group i) and 10 to 50 wt. % of monomer from group ii), in each case relative to the polymer.

The molar mass of the sulfo copolymers preferably used according to the invention may be varied in order to tailor the properties of the polymers to the desired intended application. Preferred machine dishwashing detergents are characterized in that the copolymers have molar masses of 2000 to 200,000 $gmol^{-1}$, preferably of 4000 to 25,000 $gmol^{-1}$ and in particular of 5000 to 15,000 $gmol^{-1}$.

In a first preferred embodiment, in addition to at least one monomer containing sulfonic acid groups, the copolymers furthermore comprise at least one ionic monomer.

Phosphate-free machine dishwashing detergents which contain builder, bleaching agent, nonionic surfactant, and furthermore a) copolymer comprising
  i) monomers containing sulfonic acid groups
  ii) further ionic monomers
b) methylglycinediacetic acid, are preferred according to the invention.

Unsaturated carboxylic acids are particularly preferentially used as ionic monomers. Particularly preferred unsaturated carboxylic acids are those of the general formula $R^1(R^2)C{=}C(R^3)COOH$, in which $R^1$ to $R^3$ mutually independently denote —H, —$CH_3$, a straight-chain or branched saturated alkyl residue with 2 to 12 carbon atoms, a straight-chain or branched, mono- or polyunsaturated alkenyl residue with 2 to 12 carbon atoms, alkyl or alkenyl residues substituted with —$NH_2$, —OH or —COOH as defined above or denote —COOH or —$COOR^4$, $R^4$ being a saturated or unsaturated, straight-chain or branched hydrocarbon residue with 1 to 12 carbon atoms.

Particularly preferred phosphate-free machine dishwashing detergents are accordingly those which contain builder, bleaching agent, nonionic surfactant, and furthermore a) copolymer comprising
  i) monomers containing sulfonic acid groups
  ii) monomers containing carboxyl groups of the formula $R^1(R^2)C{=}C(R^3)COOH$, in which $R^1$ to $R^3$ mutually independently denote —H, —$CH_3$, a straight-chain or branched saturated alkyl residue with 2 to 12 carbon atoms, a straight-chain or branched, mono- or polyunsaturated alkenyl residue with 2 to 12 carbon atoms, alkyl or alkenyl residues substituted with —$NH_2$, —OH or —COOH as defined above or denote —COOH or —$COOR^4$, $R^4$ being a saturated or unsaturated, straight-chain or branched hydrocarbon residue with 1 to 12 carbon atoms
b) methylglycinediacetic acid.

Particularly preferred monomers containing carboxyl groups are acrylic acid, methacrylic acid, ethacrylic acid, -chloroacrylic acid, -cyanoacrylic acid, crotonic acid, -phenylacrylic acid, maleic acid, maleic anhydride, fumaric acid, itaconic acid, citraconic acid, methylenemalonic acid, sorbic acid, cinnamic acid or mixtures thereof.

In a second preferred embodiment, in addition to at least one monomer containing sulfonic acid groups, the copolymers furthermore comprise at least one nonionic, preferably hydrophobic monomer.

Phosphate-free machine dishwashing detergents which contain builder, bleaching agent, nonionic surfactant, and furthermore a) copolymer comprising
  i) monomers containing sulfonic acid groups
  ii) further nonionic monomers
b) methylglycinediacetic acid are preferred according to the invention.

Preferably used nonionic monomers are those of the general formula $R^1(R^2)C{=}C(R^3){-}X{-}R^4$, in which $R^1$ to $R^3$ mutually independently denote —H, —$CH_3$ or —$C_2H_5$, X denotes an optionally present spacer group which is selected from —$CH_2$—, —C(O)O— and —C(O)—NH—, and $R^4$ denotes a straight-chain or branched saturated alkyl residue with 2 to 22 carbon atoms or denotes an unsaturated, preferably aromatic residue with 6 to 22 carbon atoms.

The present application accordingly preferably also provides phosphate-free machine dishwashing detergents which contain builder, bleaching agent, nonionic surfactant, and furthermore a) copolymer comprising
  i) monomers containing sulfonic acid groups
  ii) monomers of the general formula $R^1(R^2)C{=}C(R^3){-}X{-}R^4$, in which $R^1$ to $R^3$ mutually independently denote —H, —$CH_3$ or —$C_2H_5$, X denotes an optionally present spacer group which is selected from —$CH_2$—, —C(O)O— and —C(O)—NH—, and $R^4$ denotes a straight- chain or branched saturated alkyl residue with 2 to 22 carbon atoms or denotes an unsaturated, preferably aromatic residue with 6 to 22 carbon atoms
b) methylglycinediacetic acid.

Particularly preferred nonionic monomers are butene, isobutene, pentene, 3-methylbutene, 2-methylbutene, cyclopentene, hexene, 1-hexene, 2-methyl-1-pentene, 3-methyl-1-pentene, cyclohexene, methylcyclopentene, cycloheptene, methylcyclohexene, 2,4,4-trimethyl-1-pentene, 2,4,4-trimethyl-2-pentene, 2,3-dimethyl-1-hexene, 2,4-dimethyl-1-hexene, 2,5-dimethyl-1-hexene, 3,5-dimethyl-1-hexene, 4,4-dimethyl-1-hexane, ethylcyclohexyne, 1-octene, -olefins with 10 or more carbon atoms such as for example 1-decene, 1-dodecene, 1-hexadecene, 1-octadecene and C22- -olefin, 2-styrene, -methylstyrene, 3-methylstyrene, 4-propylstyrene, 4-cyclohexylstyrene, 4-dodecylstyrene, 2-ethyl-4-benzylstyrene, 1-vinylnaphthalene, 2-vinylnaphthalene, methyl acrylate, ethyl acrylate, propyl acrylate, butyl acrylate, pentyl acrylate, hexyl acrylate, methyl methacrylate, N-(methyl) acrylamide, 2-ethylhexyl acrylate, 2-ethylhexyl methacrylate, N-(2-ethylhexyl)acrylamide, octyl acrylate, octyl methacrylate, N-(octyl)acrylamide, lauryl acrylate, lauryl methacrylate, N-(lauryl)acrylamide, stearyl acrylate, stearyl methacrylate, N-(stearyl)acrylamide, behenyl acrylate, behenyl methacrylate and N-(behenoyl)acrylamide or mixtures thereof.

The machine dishwashing detergents according to the invention contain methylglycinediacetic acid (MGDA) as a second essential component. The methylglycinediacetic acid may be present in the preparations according to the invention in the form of the free acid, as a partially or completely neutralized product. In one particularly preferred embodiment, the methylglycinediacetic acid is present in the form of an alkali metal salt.

Methylglycinediacetic acid may be replaced in the dishwashing detergent according to the invention machine by other alkylglycinediacetic acids of the general formula $MOOC—CHR—N(CH_2COOM)_2$ (R═H or $C_{2-12}$ alkyl; M mutually independently H or alkali metal), but methylglycinediacetic acid is preferred for reasons of cost.

Machine dishwashing detergents which are preferred according to the invention contain one or more builders as a further essential component. Builders in particular include silicates, carbonates and organic cobuilders.

Organic cobuilders which may in particular be mentioned are polycarboxylates/polycarboxylic acids, polymeric carboxylates, aspartic acid, polyacetals, dextrins, further organic cobuilders and phosphonates. These classes of substances are described below.

Usable organic builder materials are for example polycarboxylic acids usable in the form of the free acid and/or the sodium salts thereof, polycarboxylic acids being taken to mean those carboxylic acids which bear more than one acid function. These are, for example, citric acid, adipic acid, succinic acid, glutaric acid, malic acid, tartaric acid, maleic acid, fumaric acid, saccharic acids, aminocarboxylic acids, nitrilotriacetic acid (NTA), provided that there are no objections to such use on environmental grounds. Apart from their builder action, the free acids typically also have the property of an acidifying component and so also serve to establish a lower and gentler pH value for detergents or cleaning preparations. Citric acid, succinic acid, glutaric acid, adipic acid, gluconic acid and any desired mixtures of these may in particular be mentioned.

Particularly preferred machine dishwashing detergents according to the invention contain citrate as one of their essential builders. Machine dishwashing detergents which are characterized in that they contain 5 to 60 wt. %, preferably 10 to 50 wt. % and in particular 15 to 40 wt. % of citrate are preferred according to the invention. Citrate or citric acid have proved to be the most effect builders in combination with MGDA and the copolymers containing sulfonic acid groups in terms of both washing and rinsing performance.

Phosphate-free machine dishwashing detergents which contain 5 to 60 wt. %, preferably 10 to 50 wt. % and in particular 15 to 40 wt. % of citrate, bleaching agent, nonionic surfactant, and furthermore a) copolymer comprising
   i) monomers containing sulfonic acid groups
   ii) further ionic and/or nonionic monomers
b) methylglycinediacetic acid are preferred according to the invention.

Further preferred embodiments are:

Phosphate-free machine dishwashing detergents which contain 10 to 50 wt. % of citrate, bleaching agent, nonionic surfactant, and furthermore a) copolymer comprising
   i) monomers containing sulfonic acid groups
   ii) monomers containing carboxyl groups of the formula $R^1(R^2)C═C(R^3)COOH$, in which $R^1$ to $R^3$ mutually independently denote —H, $—CH_3$, a straight-chain or branched saturated alkyl residue with 2 to 12 carbon atoms, a straight-chain or branched, mono- or polyunsaturated alkenyl residue with 2 to 12 carbon atoms, alkyl or alkenyl residues substituted with $—NH_2$, —OH or —COOH as defined above or denote —COOH or $—COOR^4$, $R^4$ being a saturated or unsaturated, straight-chain or branched hydrocarbon residue with 1 to 12 carbon atoms
b) methylglycinediacetic acid; and Phosphate-free machine dishwashing detergents which contain 10 to 50 wt. % of citrate, bleaching agent, nonionic surfactant, and furthermore a) copolymer comprising
   i) monomers containing sulfonic acid groups
   ii) monomers of the general formula $R^1(R^2)C═C(R^3)—X—R^4$, in which $R^1$ to $R^3$ mutually independently denote —H, $—CH_3$ or $—C_2H_5$, X denotes an optionally present spacer group which is selected from $—CH_2—$, —C(O)O— and —C(O)—NH—, and $R^4$ denotes a straight-chain or branched saturated alkyl residue with 2 to 22 carbon atoms or denotes an unsaturated, preferably aromatic residue with 6 to 22 carbon atoms
b) methylglycinediacetic acid.

Machine dishwashing detergents according to the invention preferentially contain as builder crystalline layered silicates of the general formula $NaMSi_xO_{2x+1} \cdot y\ H_2O$, in which M represents sodium or hydrogen, x is a number from 1.9 to 22, preferably from 1.9 to 4, particularly preferred values for x being 2, 3 or 4, and y denotes a number from 0 to 33, preferably from 0 to 20.

Amorphous sodium silicates may also be used which have an $Na_2O:SiO_2$ modulus of 1:2 to 1:3.3, preferably of 1:2 to 1:2.8 and in particular of 1:2 to 1:2.6, which are dissolution-retarded and exhibit secondary washing characteristics.

Machine dishwashing detergents preferred for the purposes of the present invention contain 2 to 15 wt. % preferably 3 to 12 wt. % and in particular 4 to 8 wt. % of silicate(s).

It is particularly preferred to use carbonate(s) and/or hydrogencarbonate(s), preferably alkali metal carbonate(s), particularly preferably sodium carbonate, in quantities of 5 to 50 wt. %, preferably of 10 to 40 wt. % and in particular of 15 to 30 wt. %, in each case relative to the weight of the machine dishwashing detergent.

Further suitable builders are polymeric polycarboxylates, these being for example the alkali metal salts of polyacrylic acid or polymethacrylic acid, for example those with a relative molecular mass of 500 to 70000 g/mol.

Suitable polymers are in particular polyacrylates, which preferably have a molecular mass of 2000 to 20000 g/mol. Due to their superior solubility, the short-chain polyacrylates from this group may in turn be preferred, these having molar masses of from 2000 to 10000 g/mol, and particularly preferably of from 3000 to 5000 g/mol.

Also suitable are copolymeric polycarboxylates, in particular those of acrylic acid with methacrylic acid and acrylic acid or methacrylic acid with maleic acid. Copolymers of acrylic acid with maleic acid containing 50 to 90 wt. % of acrylic acid and 50 to 10 wt. % of maleic acid have proven particularly suitable. Their relative molecular mass, relative to free acids, amounts in general to 2000 to 70000 g/mol, preferably 20000 to 50000 g/mol and in particular 30000 to 40000 g/mol.

The (co)polymeric polycarboxylates may be used either as a powder or as an aqueous solution. The content of (co)polymeric polycarboxylates in the machine dishwashing detergents preferably amounts to 0.5 to 20 wt. % and in particular to 3 to 10 wt. %.

Phosphonates are further suitable builders. Complex-forming phosphonates comprise a range of different compounds such as for example 1-hydroxyethane-1,1-diphosphonic acid (HEDP) or diethylenetriaminepenta (methylenephosphonic acid) (DTPMP). Hydroxyalkane- or aminoalkanephosphonates are preferred in the present application. Among hydroxyalkanephosphonates, 1-hydroxyethane-1,1-diphosphonate (HEDP) is of particular significance as a cobuilder. It is preferably used as a sodium salt, the disodium salt exhibiting a neutral reaction and the tetrasodium salt an alkaline (pH 9) reaction. Aminoalkanephosphonates which may preferably be considered are ethylenediaminetetramethylenephosphonate (EDTMP), diethylenetriaminepentamethylenephosphonate (DTPMP) as well as the higher homologs thereof. They are preferably used in the form of the sodium salts which exhibit a neutral reaction, for example as the hexasodium salt of EDTMP or as the hepta- and octasodium salt of DTPMP. From the class of phosphonates, HEDP is here preferably used as a builder. Aminoalkanephosphonates furthermore exhibit a pronounced heavy metal binding capacity. It may accordingly be preferred, especially if the preparations also contain bleach, to use aminoalkanephosphonates, in particular DTPMP, or mixtures of the stated phosphonates.

A automatic dishwashing agent which is preferred for the purposes of the present application contains one or more phosphonate(s) from the group a) aminotrimethylenephosphonic acid (ATMP) and/or the salts thereof;
b) ethylenediaminetetra(methylenephosphonic acid) (EDTMP) and/or the salts thereof;
c) diethylenetriaminepenta(methylenephosphonic acid) (DTPMP) and/or the salts thereof;
d) 1-hydroxyethane-1,1-diphosphonic acid (HEDP) and/or the salts thereof;
e) 2-phosphonobutane-1,2,4-tricarboxylic acid (PBTC) and/or the salts thereof;
f) hexamethylenediaminetetra(methylenephosphonic acid) (HDTMP) and/or the salts thereof;
g) nitrilotri(methylenephosphonic acid) (NTMP) and/or the salts thereof.

Particularly preferred machine dishwashing detergents are those which contain 1-hydroxyethane-1,1-diphosphonic acid (HEDP) or diethylene-triaminepenta(methylenephosphonic acid) (DTPMP) as phosphonates.

The machine dishwashing detergents according to the invention may, of course, contain two or more different phosphonates. Particularly preferred machine dishwashing detergents are those which contain both 1-hydroxyethane-1,1-diphosphonic acid (HEDP) and diethylenetriaminepenta (methylenephosphonic acid) (DTPMP) as phosphonates, the ratio by weight of HEDP to DTPMP amounting to between 20:1 and 1:20, preferably between 15:1 and 1:15 and in particular between 10:1 and 1:10.

In a preferred embodiment of the present invention, the proportion by weight of the phosphonate(s) in the total weight of the automatic dishwashing agent is less than the proportion by weight of the polymer(s) a). In other words, particularly preferred preparations are those in which the ratio of the proportion by weight of polymer a) to the proportion by weight of phosphonates amounts to 200:1 to 2:1, preferably 150:1 to 2:1, particularly preferably 100:1 to 2:1, very particularly preferably 80:1 to 3:1 and in particular 50:1 to 5:1.

Preferred machine dishwashing detergents according to the invention furthermore contain one or more bleaching agents. Among those compounds acting as bleaching agents which release $H_2O_2$ in water, sodium percarbonate, sodium perborate tetrahydrate and sodium perborate monohydrate are of particular significance. Further usable bleaching agents are, for example, peroxypyrophosphates, citrate perhydrates and $H_2O_2$-releasing per-acidic salts or per-acids, such as perbenzoates, peroxophthalates, diperazelaic acid, phthaloimino per-acid or diperdodecanedioic acid.

Bleaching agents from the group of organic bleaching agents may furthermore also be used. Typical organic bleaching agents are diacyl peroxides, such as for example dibenzoyl peroxide. Further typical organic bleaching agents are peroxy acids, with examples which may in particular be mentioned being alkylperoxy acids and arylperoxy acids.

Machine dishwashing detergents which are characterized in that they contain 1 to 20 wt. %, preferably 2 to 15 wt. % and in particular 4 to 12 wt. % of sodium percarbonate are preferred according to the invention.

Phosphate-free machine dishwashing detergents which contain builder, 1 to 20 wt. %, preferably 2 to 15 wt. % and in particular 4 to 12 wt. % of sodium percarbonate, nonionic surfactant, and furthermore a) copolymer comprising
   i) monomers containing sulfonic acid groups
   ii) further ionic and/or nonionic monomers
b) methylglycinediacetic acid, are preferred according to the invention.

Further preferred embodiments are:

Phosphate-free machine dishwashing detergents which contain builder, 2 to 15 wt. % of sodium percarbonate, nonionic surfactant, and furthermore a) copolymer comprising
   i) monomers containing sulfonic acid groups
   ii) monomers containing carboxyl groups of the formula $R^1(R^2)C{=}C(R^3)COOH$, in which $R^1$ to $R^3$ mutually independently denote —H, —$CH_3$, a straight-chain or branched saturated alkyl residue with 2 to 12 carbon atoms, a straight-chain or branched, mono- or polyunsaturated alkenyl residue with 2 to 12 carbon atoms, alkyl or alkenyl residues substituted with —$NH_2$, —OH or —COOH as defined above or denote —COOH or —$COOR^4$, $R^4$ being a saturated or unsaturated, straight-chain or branched hydrocarbon residue with 1 to 12 carbon atoms b) methylglycinediacetic acid; and Phosphate-free machine dishwashing detergents which contain builder, 2 to 15 wt. % of sodium percarbonate, nonionic surfactant, and furthermore a) copolymer comprising i) monomers containing sulfonic acid groups ii) monomers of the general formula $R^1(R^2)C{=}C(R^3)—X—R^4$, in which $R^1$ to $R^3$ mutually independently denote —H, $—CH_3$ or $—C_2H_5$, X denotes an optionally present spacer group which is selected from $—CH_2—$, —C(O)O— and —C(O)—NH—, and $R^4$ denotes a straight-chain or branched saturated alkyl residue with 2 to 22 carbon atoms or denotes an unsaturated, preferably aromatic residue with 6 to 22 carbon atoms b) methylglycinediacetic acid.

Substances which release chlorine or bromine may also be used as bleaching agents. Examples of suitable materials which release chlorine or bromine and may be considered are heterocyclic N-bromamides and N-chloramides, for example trichloroisocyanuric acid, tribromoisocyanuric acid, dibromoisocyanuric acid and/or dichloroisocyanuric acid (DICA) and/or the salts thereof with cations such as potassium and sodium. Hydantoin compounds, such as 1,3-dichloro-5,5-dimethylhydanthoin are likewise suitable.

In order to achieve enhanced bleaching action when washing at temperatures of 60° C. and below, the machine dishwashing detergents according to the invention may additionally contain bleaching activators. Bleaching activators which may be used are compounds which, under perhydrolysis conditions, yield aliphatic peroxycarboxylic acids with preferably 1 to 10 C atoms, in particular 2 to 4 C atoms, and/or optionally substituted perbenzoic acid. Suitable substances are those which bear O- and/or N-acyl groups having the stated number of C atoms and/or optionally substituted benzoyl groups. Polyacylated alkylenediamines are preferred, tetraacetylethylenediamine (TAED) having proved particularly suitable.

These bleaching activators, in particular TAED, are preferably used in quantities of up to 10 wt. %, in particular of 0.1 wt. % to 8 wt. %, particularly of 2 to 8 wt. % and particularly preferably of 2 to 6 wt. %, in each case relative to the total weight of the preparation containing bleaching activator.

"Bleaching catalysts" may be also used in addition to or instead of conventional bleaching activators. These substances comprise bleach-boosting transition metal salts or transition metal complexes such as for example Mn, Fe, Co, Ru or Mo salen complexes or carbonyl complexes. Mn, Fe, Co, Ru, Mo, Ti, V and Cu complexes with nitrogenous tripod ligands and Co, Fe, Cu and Ru ammine complexes may also be used as bleach catalysts.

Complexes of manganese in oxidation state II, III, IV or IV which preferably contain one or more macrocyclic ligand(s) with N, NR, PR, O and/or S donor functions are particularly preferentially used. Ligands which comprise nitrogen donor functions are preferably used. It is here particularly preferred to use bleach catalyst(s) in the preparations according to the invention which contain 1,4,7-trimethyl-1,4,7-triazacyclononane (Me-TACN), 1,4,7-triazacyclononane (TACN), 1,5,9-trimethyl-1,5,9-triazacyclododecane (Me-TACD), 2-methyl-1,4,7-trimethyl-1,4,7-triazacyclononane (Me/Me-TACN) and/or 2-methyl-1,4,7-triazacyclononane (Me/TACN) as the macromolecular ligand. Suitable manganese complexes are for example $[Mn^{III}_2((\mu\text{-}O)_1((\mu\text{-}OAc)_2(TACN)_2](ClO_4)_2$, $[Mn^{III}Mn^{IV}(\mu\text{-}O)_2(\mu\text{-}OAc),(TACN)_2](BPh4)_2$, $[Mn^{IV}_4(\mu\text{-}O)_6(TACN)_4](ClO_4)_4$, $[Mn^{III}_2((\mu\text{-}O)_1((\mu\text{-}OAc)_2(Me\text{-}TACN)_2](ClO_4)_2$, $[Mn^{III}Mn^{IV}((\mu\text{-}O)_1((\mu\text{-}OAc)_2(Me\text{-}TACN)_2](ClO_4)_3$, $[Mn^{IV}_2(\mu\text{-}O)_3(Me\text{-}TACN)_2](PF_6)_2$ and $[Mn^{IV}_2(\mu\text{-}O)_3(Me/Me\text{-}TACN)_2](PF_6)_2(OAc{=}OC(O)CH_3)$.

Machine dishwashing detergents which are characterized in that they furthermore contain a bleach catalyst selected from the group of bleach-boosting transition metal salts and transition metal complexes, preferably from the group of complexes of manganese with 1,4,7-trimethyl-1,4,7-triazacyclononane ($Me_3$-TACN) or 1,2,4,7-tetramethyl-1,4,7-triazacyclononane ($Me_4$-TACN), are preferred according to the invention since the above-stated bleaching catalysts can bring about a significant improvement in particular in the washing result.

The above-stated bleach-boosting transition metal complexes, in particular with Mn and Co central atoms are used in conventional quantities, preferably in a quantity of up to 5 wt. %, in particular of 0.0025 wt. % to 1 wt. % and particularly preferably of 0.01 wt. % to 0.30 wt. %, in each case relative to the total weight of the preparations containing bleaching activator. In specific cases, however, more bleaching activator may also be used.

The preparations according to the invention furthermore contain surfactants. Surfactants are taken to encompass nonionic, anionic, cationic and amphoteric surfactants.

It has surprisingly been found that the bleaching action of bleaching catalysts from the group of bleach-boosting transition metal salts and transition metal complexes may be enhanced by the addition of hydrophobically modified acid-containing copolymers.

The present application accordingly preferably provides a phosphate-free, automatic dishwashing agent containing bleaching agent, which automatic dishwashing agent contains a) copolymer comprising i) monomers containing sulfonic acid groups ii) further ionic and/or nonionic monomers b) methylglycinediacetic acid, c) citrate d) bleach catalyst selected from the group of bleach-boosting transition metal salts and transition metal complexes.

The following table shows some example formulations of such preferred phosphate-free machine dishwashing detergents:

| Ingredient | Formulation 1 [wt. %] | Formulation 2 [wt. %] | Formulation 3 [wt. %] | Formulation 4 [wt. %] |
|---|---|---|---|---|
| Citrate | 5 to 60 | 10 to 55 | 15 to 50 | 15 to 50 |
| Sodium percarbonate | 1 to 20 | 2 to 15 | 4 to 10 | 4 to 10 |
| Bleach catalyst | 0.01 to 3 | 0.02 to 2 | 0.02 to 2 | 0.02 to 1 |
| Copolymer[1] | 0.1 to 30 | 0.5 to 25 | 1.0 to 20 | 1.0 to 20 |
| MGDA | 0.5 to 20 | 0.5 to 20 | 0.5 to 10 | 0.5 to 8 |
| Misc | Ad 100 | Ad 100 | Ad 100 | Ad 100 |

[1]copolymer comprising i) monomers containing sulfonic acid groups ii) further nonionic monomers.

Machine dishwashing detergents which are characterized in that they contain nonionic surfactant(s) in quantities of 1 to 10 wt. %, preferably of 2 to 8 wt. % and in particular of 3 to 6 wt. %, are preferred according to the invention.

Any nonionic surfactants known to a person skilled in the art may be used as the nonionic surfactants. Examples of suitable nonionic surfactants are alkyl glycosides of the general formula $RO(G)_x$, in which R corresponds to a primary straight-chain or methyl-branched aliphatic residue, in particular methyl-branched in position 2, with 8 to 22, preferably 12 to 18 C atoms and G is the symbol which denotes a glycose unit with 5 or 6 C atoms, preferably glucose. The degree of oligomerization x, which indicates the distribution of monoglycosides and oligoglycosides, is any desired number between 1 and 10; x is preferably 1.2 to 1.4.

Nonionic surfactants of the amine oxide type, for example N-coconut alkyl-N,N-dimethylamine oxide and N-tallow alcohol-N,N-dihydroxyethylamine oxide, and of the fatty acid alkanolamide type may also be suitable. The quantity of these nonionic surfactants preferably amounts to no more than that of the ethoxylated fatty alcohols, in particular no more than half the quantity thereof.

A further class of preferably used nonionic surfactants, which may be used either as sole nonionic surfactant or in combination with other nonionic surfactants, are alkoxylated, preferably ethoxylated or ethoxylated and propoxylated fatty acid alkyl esters, preferably with 1 to 4 carbon atoms in the alkyl chain.

Low-foaming nonionic surfactants are used as preferred surfactants. Detergents or cleaning preparations, in particular cleaning preparations for machine dishwashing, particularly preferentially contain nonionic surfactants from the group of alkoxylated alcohols. Alkoxylated, advantageously ethoxylated, in particular primary alcohols with preferably 8 to 18 C atoms and on average 1 to 12 mol of ethylene oxide (EO) per mol of alcohol, in which the alcohol residue may be linear or preferably methyl-branched in position 2 or may contain linear and methyl-branched residues in the mixture, as are usually present in oxo alcohol residues, are preferably used as nonionic surfactants. In particular, however, alcohol ethoxylates with linear residues prepared from alcohols of natural origin with 12 to 18 C atoms, for example from coconut, palm, tallow fat or oleyl alcohol, and on average 2 to 8 mol of EO per mol of alcohol are preferred. Preferred ethoxylated alcohols include, for example, $C_{12-14}$ alcohols with 3 EO or 4 EO, $C_{9-11}$ alcohol with 7 EO, $C_{13-15}$ alcohols with 3 EO, 5 EO, 7 EO or 8 EO, $C_{12-18}$ alcohols with 3 EO, 5 EO or 7 EO and mixtures of these, such as mixtures of $C_{12-14}$ alcohol with 3 EO and $C_{12-18}$ alcohol with 5 EO. The stated degrees of ethoxylation are statistical averages which, for a specific product, may be an integer or a fractional number. Preferred alcohol ethoxylates have a narrow homolog distribution (narrow range ethoxylates, NRE). In addition to these nonionic surfactants, fatty alcohols with more than 12 EO may also be used. Examples of these are tallow fatty alcohol with 14 EO, 25 EO, 30 EO or 40 EO.

Ethoxylated nonionic surfactants which were obtained from $C_{6-20}$ monohydroxyalkanols or $C_{6-20}$ alkylphenols or $C_{16-20}$ fatty alcohols and more than 12 mol, preferably more than 15 mol and in particular more than 20 mol of ethylene oxide per mol of alcohol are accordingly particularly preferentially used. One particularly preferred nonionic surfactant is obtained from a straight-chain fatty alcohol having 16 to 20 carbon atoms ($C_{16-20}$ alcohol), preferably a $C_{18}$ alcohol, and at least 12 mol, preferably at least 15 mol and in particular at least 20 mol of ethylene oxide. Among these, "narrow range ethoxylates" are particularly preferred.

Combinations of one or more tallow fatty alcohols with 20 to 30 EO and silicone defoamers are particularly preferentially used.

In particular, nonionic surfactants having a melting point of above room temperature are preferred. Nonionic surfactant(s) with a melting point of above of 20° C., preferably of above 25° C., particularly preferably of between 25 and 60° C. and in particular of between 26.6 and 43.3° C., is/are particularly preferred.

Suitable nonionic surfactants which have melting or softening points in the stated temperature range are for example low-foaming nonionic surfactants which may be solid or highly viscous at room temperature. If nonionic surfactants which are highly viscous at room temperature are used, it is preferred for them to have a viscosity of above 20 Pa·s, preferably of above 35 Pa·s and in particular of above 40 Pa·s. Depending on their intended application, nonionic surfactants which have a waxy consistency at room temperature are also preferred.

Nonionic surfactants from the group of alkoxylated alcohols, particularly preferably from the group of mixed alkoxylated alcohols and in particular from the group of EO-AO-EO nonionic surfactants, are likewise particularly preferentially used.

The nonionic surfactant which is solid at room temperature preferably comprises propylene oxide units in its molecule. Such PO units preferably constitute up to 25 wt. %, particularly preferably up to 20 wt. % and in particular up to 15 wt. % of the entire molar mass of the nonionic surfactant. Particularly preferred nonionic surfactants are ethoxylated monohydroxyalkanols or alkylphenols which additionally comprise polyoxyethylene/polyoxypropylene block copolymer units. The alcohol or alkylphenol moiety of such nonionic surfactant molecules here preferably constitutes more than 30 wt. %, particularly preferably more than 50 wt. % and in particular more than 70 wt. % of the entire molar mass of such nonionic surfactants. Preferred preparations are characterized in that they contain ethoxylated and propoxylated nonionic surfactants, in which the propylene oxide units constitute in each molecule up to 25 wt. %, preferably up to 20 wt. % and in particular up to 15 wt. % of the entire molar mass of the nonionic surfactant.

Preferably used nonionic surfactants originate from the groups comprising alkoxylated nonionic surfactants, in particular ethoxylated primary alcohols and mixtures of these surfactants with structurally complex surfactants such as polyoxypropylene/polyoxyethylene/polyoxypropylene ((PO/EO/PO) surfactants). Such (PO/EO/PO) nonionic surfactants are furthermore distinguished by good foam control.

Further nonionic surfactants with a melting point above room temperature which are particularly preferably to be used contain 40 to 70% of a polyoxypropylene/polyoxyethylene/polyoxypropylene block polymer blend, which contains 75 wt. % of a reverse block copolymer of polyoxyethylene and polyoxypropylene with 17 mol of ethylene oxide and 44 mol of propylene oxide and 25 wt. % of a block copolymer of polyoxyethylene and polyoxypropylene, initiated with trimethylolpropane and containing 24 mol of ethylene oxide and 99 mol of propylene oxide per mol of trimethylolpropane.

Nonionic surfactants which have proved to be particularly preferred for the purposes of the present invention are low-foaming nonionic surfactants which comprise alternating ethylene oxide and alkylene oxide units. Among these, surfactants with EO-AO-EO-AO blocks are in turn preferred, with in each case one to ten EO or AO groups being attached to one another before being followed by a block of the respective other groups. Preferred nonionic surfactants are those of the general formula $$R^1—O—(CH_2—CH_2—O)_w—(CH_2—\underset{\underset{R^2}{|}}{CH}—O)_x—(CH_2—CH_2—O)_y—(CH_2—\underset{\underset{R^3}{|}}{CH}—O)_z—H$$

in which $R^1$ denotes a straight-chain or branched, saturated or mono- or polyunsaturated $C_{6-24}$ alkyl or alkenyl residue; each group $R^2$ or $R^3$ is mutually independently selected from —$CH_3$, —$CH_2CH_3$, —$CH_2CH_2$—$CH_3$, $CH(CH_3)_2$ and the indices w, x, y, z mutually independently denote integers from 1 to 6.

The preferred nonionic surfactants of the above formula may be produced by known methods from the corresponding alcohols $R^1$—OH and ethylene or alkylene oxide. Residue $R^1$ in the above formula may vary depending on the origin of the alcohol. If natural sources are used, the residue $R^1$ comprises an even number of carbon atoms and is generally unbranched, preference being given to linear residues from alcohols of natural origin with 12 to 18 C atoms, for example from coconut, palm, tallow fat or oleyl alcohol. Alcohols obtainable from synthetic sources are for example Guerbet alcohols or residues methyl-branched in position 2 or linear and methyl-branched residues in a mixture as are conventionally present in oxo alcohol residues. Irrespective of the nature of the alcohol used for producing nonionic surfactants contained in the preparations, preferred nonionic surfactants are those in which $R^1$ in the above formula denotes an alkyl residue with 6 to 24, preferably 8 to 20, particularly preferably 9 to 15 and in particular 9 to 11 carbon atoms.

Apart from propylene oxide, butylene oxide may in particular be considered as the alkylene oxide unit which alternates with the ethylene oxide unit in preferred nonionic surfactants. However, further alkylene oxides, in which $R^2$ or $R^3$ are mutually independently selected from —$CH_2CH_2$—$CH_3$ or —$CH(CH_3)_2$ are also suitable. Nonionic surfactants of the above formula which are preferably used are those in which $R^2$ or $R^3$ denotes a residue —$CH_3$, w and x mutually independently denote values of 3 or 4 and y and z mutually independently denote values of 1 or 2.

In summary, preferred nonionic surfactants are in particular those which comprise a $C_{9-15}$ alkyl residue with 1 to 4 ethylene oxide units, followed by 1 to 4 propylene oxide units, followed by 1 to 4 ethylene oxide units, followed by 1 to 4 propylene oxide units. In aqueous solution, these surfactants exhibit the necessary low viscosity and may particularly preferentially be used according to the invention.

Surfactants of the general formula $R^1$—$CH(OH)CH_2O$-$(AO)_w$-$(A'O)_x$-$(A''O)_y$-$(A'''O)_z$—$R^2$, in which $R^1$ and $R^2$ mutually independently denote a straight-chain or branched, saturated or mono- or polyunsaturated $C_{2-40}$ alkyl or alkenyl residue; A, A', A'' and A''' mutually independently denote a residue from the group —$CH_2CH_2$, —$CH_2CH_2$—$CH_2$, —$CH_2$—$CH(CH_3)$, —$CH_2$—$CH_2$—$CH_2$—$CH_2$, —$CH_2$—$CH(CH_3)$—$CH_2$—, —$CH_2$—$CH(CH_2$—$CH_3)$; and w, x, y and z denote values between 0.5 and 90, with x, y and/or z possibly also being 0, are preferred according to the invention.

In particular, preferred end group-terminated poly(oxyalkylated) nonionic surfactants are those which, according to the formula $R^1O[CH_2CH_2O]_xCH_2CH(OH)R^2$, in addition to a residue $R^1$, which denotes linear or branched, saturated or unsaturated, aliphatic or aromatic hydrocarbon residues with 2 to 30 carbon atoms, preferably with 4 to 22 carbon atoms, furthermore comprise a linear or branched, saturated or unsaturated, aliphatic or aromatic hydrocarbon residue $R^2$ with 1 to 30 carbon atoms, x denoting values between 1 and 90, preferably values between 30 and 80 and in particular values between 30 and 60.

Particularly preferred surfactants are those of the formula $R^1O[CH_2CH(CH_3)O]_x[CH_2CH_2O]_yCH_2CH(OH)R^2$, in which $R^1$ denotes a linear or branched aliphatic hydrocarbon residue with 4 to 18 carbon atoms or mixtures thereof, $R^2$ denotes a linear or branched hydrocarbon residue with 2 to 26 carbon atoms or mixtures thereof and x denotes values between 0.5 and 1.5 and y denotes a value of at least 15.

Particularly preferred end group-terminated poly(oxyalkylated) nonionic surfactants are furthermore those of the formula $R^1O[CH_2CH_2O]_x[CH_2CH(R^3)O]_yCH_2CH(OH)R^2$, in which $R^1$ and $R^2$ mutually independently denote a linear or branched, saturated or mono- or polyunsaturated hydrocarbon residue with 2 to 26 carbon atoms, $R^3$ is mutually independently selected from —$CH_3$, —$CH_2CH_3$, —$CH_2CH_2$—$CH_3$, —$CH(CH_3)_2$, but preferably denotes —$CH_3$, and x and y mutually independently denote values between 1 and 32, with nonionic surfactants with $R^3$=—$CH_3$ and values of x from 15 to 32 and y of 0.5 and 1.5 being very particularly preferred.

Thanks to the use of the above-described nonionic surfactants with a free hydroxyl group on one of the two terminal alkyl residues, it is possible to achieve a distinct improvement in the formation of film deposits in machine dishwashing in comparison with conventional polyalkoxylated fatty alcohols without a free hydroxyl group.

Further preferably usable nonionic surfactants are the end group-terminated poly(oxyalkylated) nonionic surfactants of the formula $R^1O[CH_2CH(R^3)O]_x[CH_2]_kCH(OH)[CH_2]_jOR^2$, in which $R^1$ and $R^2$ denote linear or branched, saturated or unsaturated, aliphatic or aromatic hydrocarbon residues with 1 to 30 carbon atoms, $R^3$ denotes H or a methyl, ethyl, n-propyl, iso-propyl, n-butyl, 2-butyl or 2-methyl-2-butyl residue, x denotes values between 1 and 30, k and j denote values between 1 and 12, preferably between 1 and 5. If the value of x is ≥2, each $R^3$ in the above formula $R^1O[CH_2CH(R^3)O]_x[CH_2]_kCH(OH)[CH_2]_jOR^2$ may be different. $R^1$ and $R^2$ are preferably linear or branched, saturated or unsaturated, aliphatic or aromatic hydrocarbon residues with 6 to 22 carbon atoms, residues with 8 to 18 C atoms being particularly preferred. H, —$CH_3$ or —$CH_2CH_3$ are particularly preferred for the residue $R^3$. Particularly preferred values for x are in the range from 1 to 20, in particular from 6 to 15.

As described above, each $R^3$ in the above formula may be different if x is ≥2. In this manner, it is possible to vary the alkylene oxide unit in the square brackets. For example, if x denotes 3, the residue $R^3$ may be selected in order to form ethylene oxide ($R^3$=H) or propylene oxide ($R^3$=$CH_3$) units, which may be attached to one another in any sequence, for example (EO)(PO)(EO), (EO)(EO)(PO), (EO)(EO)(EO), (PO)(EO)(PO), (PO)(PO)(EO) and (PO)(PO)(PO). The value 3 for x has been selected here by way of example and may perfectly well be larger, the range of variation increasing as the value of x rises and for example comprising a large number of (EO) groups combined with a small number of (PO) groups, or vice versa.

Particularly preferred end group-terminated poly(oxyalkylated) alcohols of the above-stated formula have values of k=1 and j=1, such that the above formula simplifies to $R^1O[CH_2CH(R^3)O]_xCH_2CH(OH)CH_2OR^2$. In the latter-stated formula, $R^1$, $R^2$ and $R^3$ are as defined above and x denotes numbers from 1 to 30, preferably from 1 to 20 and in particular from 6 to 18. Particularly preferred surfactants are those in which the residues $R^1$ and $R^2$ comprise 9 to 14 C atoms, $R^3$ denotes H and x assumes values from 6 to 15.

The stated C chain lengths and degrees of ethoxylation of the above-stated nonionic surfactants are statistical averages which, for a specific product, may be an integer or a fractional number. Due to production methods, commercial products of the stated formulae do not in the main consist of an individual representative, but instead of mixtures, whereby not only C-chain lengths but also the degrees of ethoxylation or degrees of alkoxylation may be averages and consequently fractional numbers.

The above-stated nonionic surfactants may, of course, be used not only as individual substances, but also as surfactant mixtures of two, three, four or more surfactants. Surfactant mixtures do not here comprise mixtures of nonionic surfactants all of which fall within one of the above-stated general formulae, but instead such mixtures which contain two, three, four or more nonionic surfactants which may be described by various of the above-stated general formulae.

Phosphate-free machine dishwashing detergents which contain builder, bleaching agent, nonionic surfactant in quantities of 1 to 10 wt. %, preferably of 2 to 8 wt. % and in particular of 3 to 6 wt. %, and furthermore a) copolymer comprising
   i) monomers containing sulfonic acid groups
   ii) further ionic and/or nonionic monomers
b) methylglycinediacetic acid, are preferred according to the invention.

The following table shows some example formulations of such preferred phosphate-free machine dishwashing detergents:

| Ingredient | Formulation 5 [wt. %] | Formulation 6 [wt. %] | Formulation 7 [wt. %] | Formulation 8 [wt. %] |
|---|---|---|---|---|
| Citrate | 5 to 60 | 10 to 55 | 15 to 50 | 15 to 50 |
| Sodium percarbonate | 1 to 20 | 2 to 15 | 4 to 10 | 4 to 10 |
| Bleach catalyst | 0.01 to 3 | 0.02 to 2 | 0.02 to 2 | 0.02 to 1 |
| Nonionic surfactant | 1 to 10 | 1 to 10 | 2 to 8 | 3 to 6 |
| Copolymer[1] | 0.1 to 30 | 0.5 to 25 | 1.0 to 20 | 1.0 to 20 |
| MGDA | 0.5 to 20 | 0.5 to 20 | 0.5 to 10 | 0.5 to 8 |
| Misc | Ad 100 | Ad 100 | Ad 100 | Ad 100 |

[1]copolymer comprising
i) monomers containing sulfonic acid groups
ii) further ionic and/or nonionic monomers Further preferred embodiments are:

Phosphate-free machine dishwashing detergents which contain builder, bleaching agent, 2 to 8 wt. % of nonionic surfactant and furthermore a) copolymer comprising
   i) monomers containing sulfonic acid groups
   ii) monomers containing carboxyl groups of the formula $R^1(R^2)C{=}C(R^3)COOH$, in which $R^1$ to $R^3$ mutually independently denote —H, —$CH_3$, a straight-chain or branched saturated alkyl residue with 2 to 12 carbon atoms, a straight-chain or branched, mono- or polyunsaturated alkenyl residue with 2 to 12 carbon atoms, alkyl or alkenyl residues substituted with —$NH_2$, —OH or —COOH as defined above or denote —COOH or —$COOR^4$, $R^4$ being a saturated or unsaturated, straight-chain or branched hydrocarbon residue with 1 to 12 carbon atoms
b) methylglycinediacetic acid; and Phosphate-free machine dishwashing detergents which contain builder, bleaching agent, 2 to 8 wt. % of nonionic surfactant and furthermore a) copolymer comprising
   i) monomers containing sulfonic acid groups
   ii) monomers of the general formula $R^1(R^2)C{=}C(R^3)$—X—$R^4$, in which $R^1$ to $R^3$ mutually independently denote —H, —$CH_3$ or —$C_2H_5$, X denotes an optionally present spacer group which is selected from —$CH_2$—, —C(O)O— and —C(O)—NH—, and $R^4$ denotes a straight-chain or branched saturated alkyl residue with 2 to 22 carbon atoms or denotes an unsaturated, preferably aromatic residue with 6 to 22 carbon atoms
b) methylglycinediacetic acid.

If anionic surfactants are used as a component of machine dishwashing detergents, the content thereof, relative to the total weight of the preparations, preferably amounts to less than 4 wt. %, preferably to less than 2 wt. % and very particularly preferably to less than 1 wt. %. Machine dishwashing detergents which contain no anionic surfactants are particularly preferred.

Cationic and/or amphoteric surfactants may be used instead of or in conjunction with the stated surfactants.

In summary, the following outline formulations are particularly preferred due to their excellent washing and rinsing results:

Phosphate-free machine dishwashing detergents which contain builder, 2 to 15 wt. % of sodium percarbonate, 2 to 8 wt. % of nonionic surfactant, and furthermore:

a) copolymer comprising
   i) monomers containing sulfonic acid groups
   ii) monomers containing carboxyl groups of the formula $R^1(R^2)C{=}C(R^3)COOH$, in which $R^1$ to $R^3$ mutually independently denote —H, —$CH_3$, a straight-chain or branched saturated alkyl residue with 2 to 12 carbon atoms, a straight-chain or branched, mono- or polyunsaturated alkenyl residue with 2 to 12 carbon atoms, alkyl or alkenyl residues substituted with —$NH_2$, —OH or —COOH as defined above or denote —COOH or —$COOR^4$, $R^4$ being a saturated or unsaturated, straight-chain or branched hydrocarbon residue with 1 to 12 carbon atoms
b) methylglycinediacetic acid; and Phosphate-free machine dishwashing detergents which contain builder, 2 to 15 wt. % of sodium percarbonate, 2 to 8 wt. % of nonionic surfactant, and furthermore:

a) copolymer comprising
   i) monomers containing sulfonic acid groups
   ii) monomers of the general formula $R^1(R^2)C{=}C(R^3)$—X—$R^4$, in which $R^1$ to $R^3$ mutually independently denote —H, —$CH_3$ or —$C_2H_5$, X denotes an optionally present spacer group which is selected from —$CH_2$—, —C(O)O— and —C(O)—NH—, and $R^4$ denotes a straight-chain or branched saturated alkyl residue with 2 to 22 carbon atoms or denotes an unsaturated, preferably aromatic residue with 6 to 22 carbon atoms b) methylglycinediacetic acid; and Phosphate-free machine dishwashing detergents which contain 10 to 50 wt. % of citrate, 2 to 15 wt. % of sodium percarbonate, 2 to 8 wt. % of nonionic surfactant, and furthermore:

a) copolymer comprising
  i) monomers containing sulfonic acid groups
  ii) monomers containing carboxyl groups of the formula $R^1(R^2)C{=}C(R^3)COOH$, in which $R^1$ to $R^3$ mutually independently denote —H, —$CH_3$, a straight-chain or branched saturated alkyl residue with 2 to 12 carbon atoms, a straight-chain or branched, mono- or polyunsaturated alkenyl residue with 2 to 12 carbon atoms, alkyl or alkenyl residues substituted with —$NH_2$, —OH or —COOH as defined above or denote —COOH or —$COOR^4$, $R^4$ being a saturated or unsaturated, straight-chain or branched hydrocarbon residue with 1 to 12 carbon atoms b) methylglycinediacetic acid; and Phosphate-free machine dishwashing detergents which contain 10 to 50 wt. % of citrate, 2 to 15 wt. % of sodium percarbonate, 2 to 8 wt. % of nonionic surfactant, and furthermore:

a) copolymer comprising
  i) monomers containing sulfonic acid groups
  ii) monomers of the general formula $R^1(R^2)C{=}C(R^3)$—X—$R^4$, in which $R^1$ to $R^3$ mutually independently denote —H, —$CH_3$ or —$C_2H_5$, X denotes an optionally present spacer group which is selected from —$CH_2$—, —C(O)O— and —C(O)—NH—, and $R^4$ denotes a straight-chain or branched saturated alkyl residue with 2 to 22 carbon atoms or denotes an unsaturated, preferably aromatic residue with 6 to 22 carbon atoms b) methylglycinediacetic acid.

Preferred machine dishwashing detergents according to the invention, in which the proportion by weight of copolymer a) amounts to 4 to 18 wt. %, preferably 6 to 15 and in particular 6 to 12 wt. % have proved particularly effective with regard to optimum washing and rinsing results.

Machine dishwashing detergents in which the proportion by weight of methylglycinediacetic acid b) amounts to 0.5 to 20 wt. %, preferably 0.5 to 10 wt. % and in particular 0.5 to 8 wt. %, likewise exhibit particularly good washing, rinsing and film deposition results and for this reason are preferred according to the invention.

Very particularly preferred phosphate-free machine dishwashing detergents are accordingly those which contain:

a) 6 to 15 wt. % of copolymer comprising
  i) monomers containing sulfonic acid groups
  ii) monomers of the general formula $R^1(R^2)C{=}C(R^3)$—X—$R^4$, in which $R^1$ to $R^3$ mutually independently denote —H, —$CH_3$ or —$C_2H_5$, X denotes an optionally present spacer group which is selected from —$CH_2$—, —C(O)O— and —C(O)—NH—, and $R^4$ denotes a straight-chain or branched saturated alkyl residue with 2 to 22 carbon atoms or denotes an unsaturated, preferably aromatic residue with 6 to 22 carbon atoms b) 0.5 to 10 wt. % of methylglycinediacetic acid c) 10 to 50 wt. % of citrate d) 2 to 15 wt. % of sodium percarbonate e) 2 to 8 wt. % of nonionic surfactant; or Phosphate-free machine dishwashing detergents which contain a) 6 to 15 wt. % of copolymer comprising:
  i) monomers containing sulfonic acid groups
  ii) monomers containing carboxyl groups of the formula $R^1(R^2)C{=}C(R^3)COOH$, in which $R^1$ to $R^3$ mutually independently denote —H, —$CH_3$, a straight-chain or branched saturated alkyl residue with 2 to 12 carbon atoms, a straight-chain or branched, mono- or polyunsaturated alkenyl residue with 2 to 12 carbon atoms, alkyl or alkenyl residues substituted with —$NH_2$, —OH or —COOH as defined above or denote —COOH or —$COOR^4$, $R^4$ being a saturated or unsaturated, straight-chain or branched hydrocarbon residue with 1 to 12 carbon atoms b) 0.5 to 10 wt. % of methylglycinediacetic acid c) 10 to 50 wt. % of citrate d) 2 to 15 wt. % of sodium percarbonate e) 2 to 8 wt. % of nonionic surfactant.

In a further preferred embodiment, in addition to the monomers containing sulfonic acid groups, the copolymers a) furthermore comprise ionic and nonionic monomers.

Phosphate-free machine dishwashing detergents which contain builder, bleaching agent, nonionic surfactant, and furthermore a) copolymer comprising
  i) monomers containing sulfonic acid groups
  ii) further ionic monomers
  iii) further nonionic monomers b) methylglycinediacetic acid, are preferred according to the invention.

These particularly preferentially comprise terpolymers as monomers containing carboxyl groups.

The present application accordingly particularly preferably provides a phosphate-free automatic dishwashing agent which contains builder, bleaching agent, nonionic surfactant, and furthermore a) copolymer comprising
  i) monomers containing sulfonic acid groups
  ii) monomers containing carboxyl groups
  iii) further nonionic monomers b) methylglycinediacetic acid.

In a final preferred embodiment, in addition to at least one monomer containing sulfonic acid groups, the copolymers furthermore contain a monomer containing carboxyl groups and, as nonionic monomers, corresponding monomers of the general formula $R^1(R^2)C{=}C(R^3)$—X—$R^4$, in which $R^1$ to $R^3$ mutually independently denote —H, —$CH_3$ or —$C_2H_5$, X denotes an optionally present spacer group which is selected from —$CH_2$—, —C(O)O— and —C(O)—NH—, and $R^4$ denotes a straight-chain or branched saturated alkyl residue with 2 to 22 carbon atoms or denotes an unsaturated, preferably aromatic residue with 6 to 22 carbon atoms.

In summary, preferred phosphate-free machine dishwashing detergents are those which, in addition to builder, bleaching agent and nonionic surfactant, furthermore contain a) copolymer comprising
  i) monomers containing sulfonic acid groups
  ii) monomers containing carboxyl groups
  iii) monomers of the general formula $R^1(R^2)C{=}C(R^3)$—X—$R^4$, in which $R^1$ to $R^3$ mutually independently denote —H, —$CH_3$ or —$C_2H_5$, X denotes an optionally present spacer group which is selected from —$CH_2$—, —C(O)O— and —C(O)—NH—, and $R^4$ denotes a straight-chain or branched saturated alkyl residue with 2 to 22 carbon atoms or denotes an unsaturated, preferably aromatic residue with 6 to 22 carbon atoms b) methylglycinediacetic acid.

Preferred machine dishwashing detergents which contain terpolymers are in particular:

Phosphate-free machine dishwashing detergents which contain a) 6 to 15 wt. % of copolymer comprising
   i) monomers containing sulfonic acid groups
   ii) monomers containing carboxyl groups
   ii) further nonionic monomers
b) 0.5 to 10 wt. % of methylglycinediacetic acid
c) 10 to 50 wt. % of citrate
d) 2 to 15 wt. % of sodium percarbonate
e) 2 to 8 wt. % of nonionic surfactant.

In addition to the ingredients described further above such as builder, bleaching agent, nonionic surfactant, copolymer a) and methylglycinediacetic acid, machine dishwashing detergents preferably contain further ingredients, preferably active ingredients from the group of polymers, enzymes, corrosion inhibitors, fragrances or dyes.

The group of polymers with a detergent or cleaning action includes for example rinsing polymers and/or polymers with a softening action. In general, in addition to nonionic polymers, it is also possible to use cationic, anionic and amphoteric polymers in detergents or cleaning preparations.

"Cationic polymers" for the purposes of the present invention are polymers which bear a positive charge in the polymer molecule. This may for example achieved by (alkyl)ammonium groupings or other positively charged groups present in the polymer chain. Particularly preferred cationic polymers originate from the groups of quaternized cellulose derivatives, polysiloxanes with quaternary groups, cationic guar derivatives, polymeric dimethyldiallylammonium salts and the copolymers thereof with esters and amides of acrylic acid and methacrylic acid, copolymers of vinylpyrrolidone with quaternized derivatives of dialkylamino acrylate and methacrylate, vinylpyrrolidone-methoimidazolinium chloride copolymers, quaternized polyvinyl alcohols or the polymers known by the INCI names Polyquaternium 2, Polyquaternium 17, Polyquaternium 18 and Polyquaternium 27.

In addition to a positively charged group in the polymer chain, "amphoteric polymers" for the purposes of the present invention furthermore also comprise negatively charged groups or monomer units. These groups may for example comprise carboxylic acids, sulfonic acids or phosphonic acids.

Preferred detergents or cleaning preparations, in particular preferred machine dishwashing detergents, are characterized in that they contain a polymer a) which comprises monomer units of the formula $R^1R^2C{=}CR^3R^4$, in which each residue $R^1$, $R^2$, $R^3$, $R^4$ is mutually independently selected from hydrogen, derivatized hydroxy group, $C_{1-30}$ linear or branched alkyl groups, aryl, aryl-substituted $C_{1-30}$ linear or branched alkyl groups, polyalkoxylated alkyl groups, heteroatomic organic groups with at least one positive charge without charged nitrogen, at least one quaternized N atom or at least one amino group with a positive charge in the subrange of the pH range from 2 to 11, or salts thereof, providing that at least one residue $R^1$, $R^2$, $R^3$, $R^4$ is a heteroatomic organic group with at least one positive charge without charged nitrogen, at least one quaternized N atom or at least one amino group with a positive charge.

Cationic or amphoteric polymers which are particularly preferred for the purposes of the present application contain as monomer unit a compound of the general formula

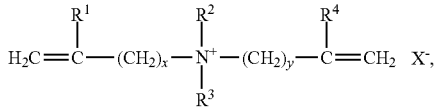

in which $R^1$ and $R^4$ mutually independently denote H or a linear or branched hydrocarbon residue with 1 to 6 carbon atoms; $R^2$ and $R^3$ mutually independently denote an alkyl, hydroxyalkyl or aminoalkyl group in which the alkyl residue is linear or branched and comprises between 1 and 6 carbon atoms, it preferably comprising a methyl group; x and y mutually independently denote integers between 1 and 3. $X^-$ represents a counterion, preferably a counterion from the group chloride, bromide, iodide, sulfate, hydrogensulfate, methosulfate, laurylsulfate, dodecylbenzenesulfonate, p-toluenesulfonate (tosylate), cumenesulfonate, xylenesulfonate, phosphate, citrate, formate, acetate or mixtures thereof.

Preferred residues $R^1$ and $R^4$ in the above formula are selected from —$CH_3$, —$CH_2$—$CH_3$, —$CH_2$—$CH_2$—$CH_3$, —$CH(CH_3)$—$CH_3$, —$CH_2$—OH, —$CH_2$—$CH_2$—OH, —CH(OH)—$CH_3$, —$CH_2$—$CH_2$—$CH_2$—OH, —$CH_2$—CH(OH)—$CH_3$, —CH(OH)—$CH_2$—$CH_3$, and —$(CH_2CH_2—O)_n$H.

Very particularly preferred polymers are those which comprise a cationic monomer unit of the above general formula, in which $R^1$ and $R^4$ denote H, $R^2$ and $R^3$ denote methyl and x and y are in each case 1. The corresponding monomer unit of the formula

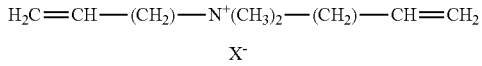

is also known as DADMAC (diallyldimethylammonium chloride) when $X^-$ is chloride.

Further particularly preferred cationic or amphoteric polymers contain a monomer unit of the general formula

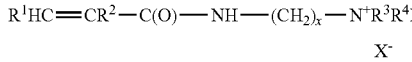

in which $R^1$, $R^2$, $R^3$, $R^4$ and $R^5$ mutually independently denote a linear or branched, saturated or unsaturated alkyl or hydroxyalkyl residue with 1 to 6 carbon atoms, preferably denote a linear or branched alkyl residue selected from —$CH_3$, —$CH_2$—$CH_3$, —$CH_2$—$CH_2$—$CH_3$, —$CH(CH_3)$—$CH_3$, —$CH_2$—OH, —$CH_2$—$CH_2$—OH, —CH(OH)—$CH_3$, —$CH_2$—$CH_2$—$CH_2$—OH, —$CH_2$—CH(OH)—$CH_3$, —CH(OH)—$CH_2$—$CH_3$, and —$(CH_2CH_2—O)_n$H and x denotes an integer between 1 and 6.

Polymers which are very particularly preferred for the purposes of the present application are those which comprise a cationic monomer unit of the above general formula, in which $R^1$ denotes H and $R^2$, $R^3$, $R^4$ and $R^5$ denote methyl and x denotes 3. The corresponding monomer units of the formula

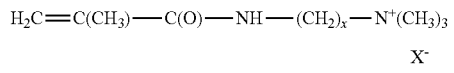

are also known as MAPTAC (methyacrylamidopropyltrimethylammonium chloride) when $X^-$ is chloride.

Polymers which contain diallyldimethylammonium salts and/or acrylamidopropyltrimethylammonium salts as monomer units are preferably used according to the invention.

The previously mentioned amphoteric polymers comprise not only cationic groups, but also anionic groups or monomer units. Such anionic monomer units originate for example from the group of linear or branched, saturated or unsaturated carboxylates, linear or branched, saturated or unsaturated phosphonates, linear or branched, saturated or unsaturated sulfates or linear or branched, saturated or unsaturated sulfonates. Preferred monomer units are acrylic acid, (meth)acrylic acid, (dimethyl)acrylic acid, (ethyl) acrylic acid, cyanoacrylic acid, vinylacetic acid, allylacetic acid, crotonic acid, maleic acid, fumaric acid, cinnamic acid and the derivatives thereof, allylsulfonic acids, such as for example allyloxybenzenesulfonic acid and methallylsulfonic acid or allylphosphonic acids.

Preferably usable amphoteric polymers originate from the group of alkylacrylamide/acrylic acid copolymers, alkylacrylamide/methacrylic acid copolymers, alkylacrylamide/methyl methacrylic acid copolymers, alkylacrylamide/acrylic acid/alkylaminoalkyl(meth)acrylic acid copolymers, alkylacrylamide/methacrylic acid/alkylaminoalkyl(meth) acrylic acid copolymers, alkylacrylamide/methyl methacrylic acid/alkylaminoalkyl(meth)acrylic acid copolymers, alkylacrylamide/alkyl methacrylate/alkylaminoethyl methacrylate/alkyl methacrylate copolymers and copolymers of unsaturated carboxylic acids, cationically derivatized unsaturated carboxylic acids and optionally further ionic or nonionogenic monomers.

Preferably usable zwitterionic polymers originate from the group of acrylamidoalkyltrialkylammonium chloride/acrylic acid copolymers and the alkali metal and ammonium salts thereof, acrylamidoalkyltrialkylammonium chloride/methacrylic acid copolymers and the alkali metal and ammonium salts thereof and methacroylethylbetaine/methacrylate copolymers.

Amphoteric polymers which, in addition to one or more anionic monomers, comprise methacrylamidoalkyltrialkylammonium chloride and dimethyl(diallyl)ammonium chloride as cationic monomers are furthermore preferred.

Particularly preferred amphoteric polymers originate from the group of methacrylamidoalkyltrialkylammonium chloride/dimethyl(diallyl)ammonium chloride/acrylic acid copolymers, methacrylamidoalkyltrialkylammonium chloride/dimethyl(diallyl)ammonium chloride/methacrylic acid copolymers and methacrylamidoalkyltrialkylammonium chloride/dimethyl(diallyl)ammonium chloride/alkyl(meth) acrylic acid copolymers and the alkali metal and ammonium salts thereof.

Particularly preferred amphoteric polymers are those from the group of methacrylamidopropyltrimethylammonium chloride/dimethyl(diallyl)ammonium chloride/acrylic acid copolymers, methacrylamidopropyltrimethylammonium chloride/dimethyl(diallyl)ammonium chloride/acrylic acid copolymers and methacrylamidopropyltrimethylammonium chloride/dimethyl(diallyl)ammonium chloride/alkyl (meth)acrylic acid copolymers and the alkali metal and ammonium salts thereof.

In one particularly preferred embodiment of the present invention, the polymers assume preformulated form. The polymers may here suitably be formulated inter alia by

- encapsulating the polymers by means of water-soluble or water-dispersible coating compositions, preferably by means of water-soluble or water-dispersible natural or synthetic polymers;
- encapsulating the polymers by means of water-insoluble, fusible coating compositions, preferably by means of water-insoluble coating compositions from the group of waxes or paraffins with a melting point above 30° C.;
- cogranulating the polymers with inert carrier materials, preferably with carrier materials from the group of substances with a detergent or cleaning action, particularly preferably from the group of builders or cobuilders.

Detergents or cleaning preparations preferably contain the above-stated cationic and/or amphoteric polymers in quantities between 0.01 and 10 wt. %, in each case relative to the total weight of the detergent or cleaning preparation. Detergents or cleaning preparations which are preferred for the purposes of the present application are, however, those in which the proportion by weight of the cationic and/or amphoteric polymers amounts to between 0.01 and 8 wt. %, preferably between 0.01 and 6 wt. %, preferably between 0.01 and 4 wt. %, particularly preferably between 0.01 and 2 wt. % and in particular between 0.01 and 1 wt. %, in each case relative to the total weight of the machine dishwashing detergent.

Enzymes may be used to increase the washing or cleaning performance of detergents or cleaning preparations. These include in particular proteases, amylases, lipases, hemicellulases, cellulases, perhydrolases or oxidoreductases, and preferably mixtures thereof. These enzymes are in principle of natural origin; starting from the natural molecules, improved variants are available for use in detergents or cleaning preparations, said variants accordingly preferably being used. Detergents or cleaning preparations preferably contain enzymes in total quantities of $1\times10^{-6}$ to 5 wt. % relative to active protein. Protein concentration may be determined with the assistance of known methods, for example the BCA method or the biuret method.

Among proteases, those of the subtilisin type are preferred. Examples of these are subtilisins BPN' and Carlsberg and their further developed forms protease PB92, subtilisins 147 and 309, alkaline protease from *Bacillus lentus*, subtilisin DY and the enzymes thermitase, proteinase K and proteases TW3 and TW7, which are classed among subtilases but no longer among the subtilisins as more narrowly defined.

Examples of amylases usable according to the invention are the α-amylases from *Bacillus licheniformis*, from *B. amyloliquefaciens*, from *B. stearothermophilus*, from *Aspergillus niger* and *A. oryzae* and the further developed forms of the above-stated amylases which have been improved for use in detergents and cleaning agents. Particular note should furthermore be taken for this purpose of the α-amylase from *Bacillus* sp. A 7-7 (DSM 12368) and the cyclodextrin glucanotransferase (CGTase) from *B. agaradherens* (DSM 9948).

Lipases or cutinases, in particular because of their triglyceride-cleaving activities, but also in order to produce peracids in situ from suitable precursors may furthermore be used according to the invention. These include, for example, lipases originally obtainable or further developed from *Humicola lanuginosa* (*Thermomyces lanuginosus*), in particular those with the D96L amino acid substitution. Furthermore, the cutinases which were originally isolated from *Fusarium solani pisi* and *Humicola insolens* are, for example, also usable. Lipases or cutinases, the initial enzymes of which were originally isolated from *Pseudomonas mendocina* and *Fusarium solanji*, may furthermore be used.

Enzymes which fall within the class of hemicellulases may furthermore be used. These include, for example, mannanases, xanthan lyases, pectin lyases (=pectinases), pectin esterases, pectate lyases, xyloglucanases (=xylanases), pullulanases and β-glucanases.

Oxidoreductases, for example oxidases, oxygenases, catalases, peroxidases, such as halo-, chloro-, bromo-, lignin, glucose or manganese peroxidases, dioxygenases or laccases (phenol oxidases, polyphenol oxidases) may be used according to the invention to increase bleaching action. Compounds, preferably organic compounds, particularly preferably aromatic compounds, which interact with the enzymes are advantageously also added in order to enhance the activity of the oxidoreductases in question (enhancers) or, in the event of a major difference in redox potential between the oxidizing enzymes and the soiling, to ensure electron flow (mediators).

The enzymes may be used in any form established in the prior art. This includes, for example, solid preparations obtained by granulation, extrusion or freeze-drying or, in particular in the case of preparations in liquid or gel form, solutions of the enzymes, advantageously as concentrated as possible, with a low water content and/or combined with stabilizers.

Alternatively, both for the solid and the liquid presentation, the enzymes may be encapsulated, for example by spray drying or extruding the enzyme solution together with a preferably natural polymer or in the form of capsules, for example those in which the enzymes are enclosed as a solidified gel or in those of the core-shell type, in which an enzyme-containing core is coated with a protective layer which is impermeable to water, air and/or chemicals. Further active ingredients, for example stabilizers, emulsifiers, pigments, bleaching agents or dyes may additionally be applied in superimposed layers. Such capsules are applied in accordance with per se known methods, for example by agitated or rolling granulation or in fluidized bed processes. Advantageously, such granules are low-dusting, for example due to the application of a polymeric film former, and stable in storage thanks to the coating.

It is furthermore possible to formulate two or more enzymes together such that a single granular product displays two or more enzyme activities.

A protein and/or enzyme may be protected, particularly during storage, from damage such as for example inactivation, denaturation or degradation for instance due to physical influences, oxidation or proteolytic cleavage. If the proteins and/or enzymes are isolated from microbes, inhibition of proteolysis is particularly preferred, in particular if the preparations also contain proteases. Detergents or cleaning preparations may contain stabilizers for this purpose; the provision of such preparations constitutes a preferred embodiment of the present invention.

One or more enzymes and/or enzyme preparations, preferably solid protease preparations and/or amylase preparations, are preferably used in quantities of 0.1 to 5 wt. %, preferably of 0.2 to 5 wt. % and in particular of 0.4 to 5 wt. %, in each case relative to the entire enzyme-containing preparations.

Very particularly preferred phosphate-free machine dishwashing detergents are accordingly those which contain a) 6 to 15 wt. % of copolymer comprising
  i) monomers containing sulfonic acid groups
  ii) monomers of the general formula $R^1(R^2)C{=}C(R^3){-}X{-}R^4$, in which $R^1$ to $R^3$ mutually independently denote —H, —$CH_3$ or —$C_2H_5$, X denotes an optionally present spacer group which is selected from —$CH_2$—, —C(O)O— and —C(O)—NH—, and $R^4$ denotes a straight-chain or branched saturated alkyl residue with 2 to 22 carbon atoms or denotes an unsaturated, preferably aromatic residue with 6 to 22 carbon atoms
b) 0.5 to 10 wt. % of methylglycinediacetic acid
c) 10 to 50 wt. % of citrate
d) 2 to 15 wt. % of sodium percarbonate
e) 2 to 8 wt. % of nonionic surfactant
f) 1.0 to 6 wt. % of enzyme.

or

Phosphate-free machine dishwashing detergents which contain a) 6 to 15 wt. % of copolymer comprising
  i) monomers containing sulfonic acid groups
  ii) monomers containing carboxyl groups of the formula $R^1(R^2)C{=}C(R^3)COOH$, in which $R^1$ to $R^3$ mutually independently denote —H, —$CH_3$, a straight-chain or branched saturated alkyl residue with 2 to 12 carbon atoms, a straight-chain or branched, mono- or polyunsaturated alkenyl residue with 2 to 12 carbon atoms, alkyl or alkenyl residues substituted with —$NH_2$, —OH or —COOH as defined above or denote —COOH or —$COOR^4$, $R^4$ being a saturated or unsaturated, straight-chain or branched hydrocarbon residue with 1 to 12 carbon atoms
b) 0.5 to 10 wt. % of methylglycinediacetic acid
c) 10 to 50 wt. % of citrate
d) 2 to 15 wt. % of sodium percarbonate
e) 2 to 8 wt. % of nonionic surfactant
f) 1.0 to 6 wt. % of enzyme.

and

Phosphate-free machine dishwashing detergents which contain a) 6 to 15 wt. % of copolymer comprising
  i) monomers containing sulfonic acid groups
  ii) monomers containing carboxyl groups of the formula $R^1(R^2)C{=}C(R^3)COOH$, in which $R^1$ to $R^3$ mutually independently denote —H, —$CH_3$, a straight-chain or branched saturated alkyl residue with 2 to 12 carbon atoms, a straight-chain or branched, mono- or polyunsaturated alkenyl residue with 2 to 12 carbon atoms, alkyl or alkenyl residues substituted with —$NH_2$, —OH or —COOH as defined above or denote —COOH or —$COOR^4$, $R^4$ being a saturated or unsaturated, straight-chain or branched hydrocarbon residue with 1 to 12 carbon atoms
  iii) monomers of the general formula $R^1(R^2)C{=}C(R^3){-}X{-}R^4$, in which $R^1$ to $R^3$ mutually independently denote —H, —$CH_3$ or —$C_2H_5$, X denotes an optionally present spacer group which is selected from —$CH_2$—, —C(O)O— and —C(O)—NH—, and $R^4$ denotes a straight-chain or branched saturated alkyl residue with 2 to 22 carbon atoms or denotes an unsaturated, preferably aromatic residue with 6 to 22 carbon atoms
b) 0.5 to 10 wt. % of methylglycinediacetic acid
c) 10 to 50 wt. % of citrate
d) 2 to 15 wt. % of sodium percarbonate e) 2 to 8 wt. % of nonionic surfactant f) 1.0 to 6 wt. % of enzyme.

The following tables show some example formulations of such preferred phosphate-free machine dishwashing detergents:

| Ingredient | Formulation 9 [wt. %] | Formulation 10 [wt. %] | Formulation 11 [wt. %] | Formulation 12 [wt. %] |
|---|---|---|---|---|
| Citrate | 5 to 60 | 10 to 55 | 15 to 50 | 15 to 50 |
| Sodium percarbonate | 1 to 20 | 2 to 15 | 4 to 10 | 4 to 10 |
| Nonionic surfactant | 1 to 10 | 2 to 8 | 2 to 8 | 3 to 6 |
| Enzyme | 0.1 to 6 | 0.2 to 5 | 0.4 to 5 | 0.4 to 5 |
| Copolymer[1] | 0.1 to 30 | 0.5 to 25 | 1.0 to 20 | 1.0 to 20 |
| MGDA | 0.5 to 20 | 0.5 to 20 | 0.5 to 10 | 0.5 to 8 |
| Misc | Ad 100 | Ad 100 | Ad 100 | Ad 100 |

| Ingredient | Formulation 13 [wt. %] | Formulation 14 [wt. %] | Formulation 15 [wt. %] | Formulation 16 [wt. %] |
|---|---|---|---|---|
| Citrate | 5 to 60 | 10 to 55 | 15 to 50 | 15 to 50 |
| Carbonate/ hydrogen carbonate | 2 to 40 | 2 to 40 | 2 to 40 | 2 to 40 |
| Silicate | 0 to 15 | 0 to 15 | 0 to 15 | 0.1 to 10 |
| Sodium percarbonate | 1 to 20 | 2 to 15 | 4 to 10 | 4 to 10 |
| Bleach catalyst | 0.01 to 3 | 0.02 to 2 | 0.02 to 2 | 0.02 to 1 |
| Nonionic surfactant | 1 to 10 | 2 to 8 | 2 to 8 | 3 to 6 |
| Enzyme | 0.1 to 6 | 0.2 to 5 | 0.4 to 5 | 0.4 to 5 |
| Copolymer[1] | 0.1 to 30 | 0.5 to 25 | 1.0 to 20 | 1.0 to 20 |
| MGDA | 0.5 to 20 | 0.5 to 20 | 0.5 to 10 | 0.5 to 8 |
| Misc | Ad 100 | Ad 100 | Ad 100 | Ad 100 |

[1]a) copolymer comprising i) monomers containing sulfonic acid groups ii) further nonionic monomers b) methylglycinediacetic acid.

Glass corrosion inhibitors prevent the occurrence not only of hazing, streaking and scratching but also of iridescence on the surface of machine washed glasses. Preferred glass corrosion inhibitors originate from the group of magnesium and zinc salts and of magnesium and zinc complexes.

The spectrum of zinc salts preferred according to the invention, preferably of organic acids, particularly preferably of organic carboxylic acids, extends from salts which are sparingly soluble or insoluble in water, i.e. exhibit a solubility of below 100 mg/l, preferably below 10 mg/l, in particular below 0.01 mg/l, up to those salts which display a solubility in water of above 100 mg/l, preferably of above 500 mg/l, particularly preferably of above 1 g/l and in particular of above 5 g/l (all solubilities at 20° C. water temperature). The first group of zinc salts includes for example zinc citrate, zinc oleate and zinc stearate, while the group of soluble zinc salts includes for example zinc formate, zinc acetate, zinc lactate and zinc gluconate.

At least one zinc salt of an organic carboxylic acid, particularly preferably a zinc salt from the group of zinc stearate, zinc oleate, zinc gluconate, zinc acetate, zinc lactate and zinc citrate is particularly preferentially used as a glass corrosion inhibitor. Zinc ricinoleate, zinc abietate and zinc oxalate are also preferred.

For the purposes of the present invention, the content of zinc salt in detergents or cleaning preparations preferably amounts to between 0.1 and 5 wt. %, preferably between 0.2 and 4 wt. % and in particular between 0.4 and 3 wt. %, or the content of zinc in oxidized form (calculated as $Zn^{2+}$) amounts to between 0.01 and 1 wt. %, preferably between 0.02 and 0.5 wt. % and in particular between 0.04 and 0.5 wt. %, in each case relative to the total weight of the preparation containing the glass corrosion inhibitor.

Corrosion inhibitors serve to protect the items being washed or the machine, silver protection agents being of particular significance in relation to machine dishwashing. Known prior art substances may be used. In general, silver protection agents which may be used are those primarily selected from the group of triazoles, benzotriazoles, bisbenzotriazoles, aminotriazoles, alkylaminotriazoles and transition metal salts or complexes. Benzotriazole and/or alkylaminotriazole are particularly preferably used. 3-Amino-5-alkyl-1,2,4-triazoles or the physiologically acceptable salts thereof are preferably used according to the invention, these substances particularly preferentially being used in a concentration of 0.001 to 10 wt. %, preferably of 0.0025 to 2 wt. %, particularly preferably of 0.01 to 0.04 wt. %.

Disintegration of the prefabricated moldings may be facilitated by incorporating disintegration auxiliaries or "tablet disintegrants" into these preparations in order to shorten disintegration times.

These substances, known as disintegrants due to their mode of action, increase in volume on exposure to water, resulting, on the one hand, in an increase of their own volume (swelling) and, on the other hand, possibly also in generation of pressure due to the release of gases, causing the tablet to break up into smaller particles. Disintegration auxiliaries which have long been known are for example carbonate/citric acid systems, it also being possible to use other organic acids. Swelling disintegration auxiliaries are for example synthetic polymers such as polyvinylpyrrolidone (PVP) or natural polymers or modified natural materials such as cellulose and starch and the derivatives thereof, alginates or casein derivatives.

Disintegration auxiliaries are preferably used in quantities of 0.5 to 10 wt. %, preferably of 3 to 7 wt. % and in particular of 4 to 6 wt. %, in each case relative to the total weight of the preparation containing the disintegration auxiliary.

Preferably used disintegration agents are those based on cellulose, such that preferred detergents or cleaning preparations contain such a cellulose-based disintegration agent in quantities of 0.5 to 10 wt. %, preferably of 3 to 7 wt. % and in particular of 4 to 6 wt. %. The cellulose used as a disintegration auxiliary is preferably not used in finely divided form, but is instead converted into a coarser form, for example is granulated or compacted, before being mixed into the premixes which are to be pressed. The particle sizes of such disintegration agents are for the most part above 200 μm, at least 90 wt. % preferably being between 300 and 1600 μm and in particular at least 90 wt. % being between 400 and 1200 μm.

Preferred disintegration auxiliaries, preferably a cellulose-based disintegration auxiliary, preferably in granular, cogranulated or compacted form, are present in the preparation containing the disintegration agent in quantities of 0.5 to 10 wt. %, preferably of 3 to 7 wt. % and in particular of 4 to 6 wt. %, in each case relative to the total weight of the preparation containing the disintegration agent.

Gas-evolving effervescent systems may furthermore preferably be used according to the invention as tablet disintegration auxiliaries. The gas-evolving effervescent system may consist of a single substance which releases a gas on contact with water. Magnesium peroxide, which releases oxygen on contact with water, may in particular be mentioned among these compounds. Preferred effervescent systems, however, consist of at least two components which react together with formation of gas, for example of alkali metal carbonate and/or hydrogencarbonate and an acidifying agent which is suitable for releasing carbon dioxide from the alkali metal salt in aqueous solution. Usable acidifying agents which release carbon dioxide from the alkali metal salts in aqueous solution are, for example, boric acid and alkali metal hydrogensulfates, alkali metal dihydrogenphosphates and other inorganic salts. Organic acidifying agents are, however, preferably used, citric acid being a particularly preferred acidifying agent. Preferred acidifying agents in the effervescent system are from the group of organic di-, tri- and oligocarboxylic acids or mixtures.

Perfume oils or fragrances which may be used for the purposes of the present invention are individual odoriferous compounds, for example synthetic products of the ester, ether, aldehyde, ketone, alcohol and hydrocarbon type. Preferably, however, mixtures of various odoriferous substances are used which together produce an attractive fragrance note. Such perfume oils may also contain natural odoriferous mixtures, as are obtainable from plant sources, for example pine, citrus, jasmine, patchouli, rose or ylang-ylang oil.

The fragrances may be directly processed, but it may also be advantageous to apply the fragrances onto carriers which ensure a long-lasting fragrance thanks to slower fragrance release. Cyclodextrins have, for example, proved to be effective such carrier materials, it being possible additionally to coat the cyclodextrin-perfume complexes with further auxiliary substances.

Preferred dyes, the selection of which will cause the person skilled in the art no difficulty, have elevated storage stability and are insensitive to the other ingredients of the preparations and to light and have no marked substantivity relative to the substrates such as for example textiles, glass, ceramics or plastic crockery to be treated with the preparations so as not to dye these substrates.

The automatic dishwashing agent according to the invention may be formulated in solid or liquid form, but may, for example, also assume the form of a combination of solid and liquid presentations.

Suitable solid presentations are in particular powders, granules, extrudates or compacted products, in particular tablets. The liquid presentations based on water and/or organic solvents may be thickened, assuming gel form.

Preparations according to the invention may be formulated as monophasic or multiphasic products. Preferred machine dishwashing detergents are in particular those with one, two, three or four phases. Machine dishwashing detergents which are characterized in that they assume the form of a prefabricated dispensing unit with two or more phases are particularly preferred.

The individual phases of multiphasic preparations may be of identical or different states of aggregation. Preferred machine dishwashing detergents are in particular those which comprise at least two different solid phases and/or at least two liquid phases and/or at least one solid and at least one liquid phase.

Machine dishwashing detergents according to the invention are preferably preformulated as dispensing units. These dispensing units preferably comprise the quantity of substances with a detergent or cleaning action required for a washing operation. Preferred dispensing units have a weight of between 12 and 30 g, preferably of between 14 and 26 g and in particular of between 15 and 22 g.

The volume of the above-stated dispensing units and their three-dimensional shape are particularly preferentially selected such that the preformulated units can be dispensed by means of the dispensing chamber of a dishwashing machine. The volume of the dispensing unit therefore preferably amounts to between 10 and 35 ml, preferably between 12 and 30 ml and in particular between 15 and 25 ml.

The machine dishwashing detergents according to the invention, in particular the prefabricated dispensing units, particularly preferentially comprise a water-soluble covering.

The present application furthermore provides a method for washing dishes in a dishwashing machine using machine dishwashing detergents according to the invention, the machine dishwashing detergents preferably being dispensed into the interior of a dishwashing machine during the performance of a dishwashing program, before the start of the main washing cycle or in the course of the main washing cycle. Dispensing or introduction of the preparation according to the invention into the interior of the dishwashing machine may proceed manually, but the preparation is preferably dispensed into the interior of the dishwashing machine by means of the dispensing chamber of the dishwashing machine. Preferably, no additional water softener and no additional rinse agent is dispensed into the interior of the dishwashing machine in the course of the washing method.

As described above, preparations according to the invention are distinguished by an improved rinsing action in comparison with conventional machine dishwashing detergents. The present application accordingly also provides the use of a automatic dishwashing agent according to the invention as a rinse agent in machine dishwashing.

While particular embodiments of the present invention have been illustrated and described, it would be obvious to those skilled in the art that various other changes and modifications can be made without departing from the spirit and scope of the invention.

Other than where otherwise indicated, or where required to distinguish over the prior art, all numbers expressing quantities of ingredients herein are to be understood as modified in all instances by the term "about". As used herein, the words "may" and "may be" are to be interpreted in an open-ended, non-restrictive manner. At minimum, "may" and "may be" are to be interpreted as definitively including, but not limited to, the composition, structure, or act recited.

As used herein, and in particular as used herein to define the elements of the claims that follow, the articles "a" and "an" are synonymous and used interchangeably with "at least one" or "one or more," disclosing or encompassing both the singular and the plural, unless specifically defined herein otherwise. The conjunction "or" is used herein in both in the conjunctive and disjunctive sense, such that phrases or terms conjoined by "or" disclose or encompass each phrase or term alone as well as any combination so conjoined, unless specifically defined herein otherwise.

The description of a group or class of materials as suitable or preferred for a given purpose in connection with the invention implies that mixtures of any two or more of the members of the group or class are equally suitable or preferred. Description of constituents in chemical terms refers unless otherwise indicated, to the constituents at the time of addition to any combination specified in the description, and does not necessarily preclude chemical interactions among the constituents of a mixture once mixed. Steps in any method disclosed or claimed need not be performed in the order recited, except as otherwise specifically disclosed or claimed.

Changes in form and substitution of equivalents are contemplated as circumstances may suggest or render expedient. Although specific terms have been employed herein, such terms are intended in a descriptive sense and not for purposes of limitation.

The following Examples further illustrate the preferred embodiments within the scope of the present invention, but are not intended to be limiting thereof. It is understood that the examples and embodiments described herein are for illustrative purposes only and that various modifications or changes in light thereof will be suggested to one skilled in the art without departing from the scope of the present invention. The appended claims therefore are intended to cover all such changes and modifications that are within the scope of this invention.

EXAMPLES

In a first washing test, soiled dishes were washed in a dishwashing machine with 21 g of a conventional commercial automatic dishwashing agent containing phosphate (comparison 1) or 21 g of three phosphate-free machine dishwashing detergents (comparison 2, comparison 3 and invention 1) at a water hardness of 21 German hardness degrees.

The following table shows the composition of the dishwashing detergents used:

| Raw material | Comparison 1 | Comparison 2 | Comparison 3 | Invention 1 |
|---|---|---|---|---|
| Phosphate | 33 | — | — | — |
| Citrate | — | 23 | 23 | 23 |
| MGDA | — | — | 8.0 | 8.0 |
| Copolymer[1] | 12.0 | 12.0 | — | 12.0 |
| HEDP | 2.0 | 2.0 | 2.0 | 2.0 |
| Soda | 28.0 | 28.0 | 28.0 | 28.0 |
| Sodium percarbonate | 10.0 | 10.0 | 10.0 | 10.0 |
| TAED | 2.4 | 2.4 | 2.4 | 2.4 |
| Protease/amylase | 4.0 | 4.0 | 4.0 | 4.0 |
| Nonionic surfactant | 5.0 | 5.0 | 5.0 | 5.0 |
| Misc | Ad 100 | Ad 100 | Ad 100 | Ad 100 |

[1]copolymer containing sulfonic acid groups

The overall appearance of the washed dishes was assessed against the evaluation scale shown below. The results are stated in the following table (the stated values are averages from 3 tests):

| | Comparison 1 | Comparison 2 | Comparison 3 | Invention 1 |
|---|---|---|---|---|
| Washing result | 8.1 | 7.1 | 7.5 | 8.2 |

Evaluation scale for washing: 10=no dirt to 0=serious dirt (average over seven specific types of soiling)

In a second test for determining film deposition, unsoiled dishes were washed in a continuously operated dishwashing machine with 21 g of a conventional commercial automatic dishwashing agent containing phosphate (comparison 1) or 21 g of three phosphate-free machine dishwashing detergents (comparison 2, comparison 3 and invention 1) at a water hardness of 21 German hardness degrees.

The overall appearance of the washed dishes was assessed against the evaluation scale shown below. The results are stated in the following table (the stated values are averages from 3 tests):

| | Comparison 1 | Comparison 2 | Comparison 3 | Invention 1 |
|---|---|---|---|---|
| Film deposition | porcelain 3.5<br>plastics 4.2 | porcelain 1.5<br>plastics 1.0 | porcelain 2.5<br>plastics 3.0 | porcelain 3.0<br>plastics 4.5 |

Evaluation scale for film deposition: 10=no film deposition to 0=severe film deposition

What is claimed:

1. A phosphate-free automatic dishwashing agent comprising a builder, a bleaching agent, a nonionic surfactant, and:

a) a copolymer comprising:

i) 50% to 95% by weight of a monomer containing a sulfonic acid group;

ii) a monomer of the general formula $R^1(R^2)C{=}C(R^3)—X—R^4$, in which $R^1$ and $R^2$ are —H, $R^3$ is —H or $—CH_3$, X is —C(O)O—, and $R^4$ denotes a straight-chain or branched saturated alkyl residue with 2 to 22 carbon atoms or denotes an unsaturated, optionally aromatic residue with 6 to 22 carbon atoms; and iii) a mono- or polyunsaturated carboxylic acid monomer; and b) methylglycinediacetic acid, wherein the nonionic surfactant is of the general formula:

$$R^1O[CH_2CH_2O]_x[CH_2\ CH(R^3)O]_yCH_2CH(OH)R^2,$$

in which $R^1$and $R^2$ mutually independently are selected from a linear or branched, saturated or mono- or polyunsaturated hydrocarbon residue with 2 to 26 carbon atoms, $R^3$ is mutually independently selected from $—CH_2CH_2—CH_3$,and $—CH(CH_3)_2$ , and the indices x and y mutually independently are selected from 1 to 32.

2. The automatic dishwashing agent of claim 1, comprising 4% to 18% by weight of the copolymer a).

3. The automatic dishwashing agent of claim 2, comprising 6% to 15% by weight of the copolymer a).

4. The automatic dishwashing agent of claim 3, comprising 6% to 12% by weight of the copolymer a).

5. The automatic dishwashing agent of claim 1, comprising 0.5% to 20% by weight of the methylglycinediacetic acid b).

6. The automatic dishwashing agent of claim 5, comprising 0.5% to 10% by weight of the methylglycinediacetic acid b).

7. The automatic dishwashing agent of claim 6, comprising 0.5% to 8% by weight of the methylglycinediacetic acid b).

8. The automatic dishwashing agent of claim 1, wherein the builder comprises a citrate, and the automatic dishwashing agent comprises 5% to 60% by weight of the citrate.

9. The automatic dishwashing agent of claim 8, comprising 10% to 50% by weight of the citrate.

10. The automatic dishwashing agent of claim 9, comprising 15% to 40% by weight of the citrate.

11. The automatic dishwashing agent of claim 1, wherein the bleaching agent comprises sodium percarbonate, and the automatic dishwashing agent comprises 1% to 20% by weight of the sodium percarbonate.

12. The automatic dishwashing agent of claim 11, comprising 2% to 15% by weight of the sodium percarbonate.

13. The automatic dishwashing agent of claim 12, comprising 4% to 12% by weight of the sodium percarbonate.

14. The automatic dishwashing agent of claim 1, comprising 1% to 10% by weight of the nonionic surfactant.

15. The automatic dishwashing agent of claim 14, comprising 2% to 8% by weight of the nonionic surfactant.

16. The automatic dishwashing agent of claim 15, comprising 3% to 6% by weight of the nonionic surfactant.

17. The automatic dishwashing agent of claim 1, comprising:

a) 6 to 15 wt. % of the copolymer;

b) 0.5 to 10 wt. % of the methylglycinediacetic acid;

c) 10 to 50 wt. % of the builder, wherein the builder comprises citrate;

d) 2 to 15 wt. % of the bleaching agent, wherein the bleaching agent comprises sodium percarbonate; and e) 2 to 8 wt. % of the nonionic surfactant.

18. The automatic dishwashing agent of claim 17, further comprising 1.0 to 6 wt. % of enzyme.

19. A method for washing dishes in an automatic dishwasher, comprising contacting a dish in need of washing with an effective amount of the automatic dishwashing agent of claim 1 in a washing cycle of an automatic dishwasher.

20. The method of claim 19, wherein no additional water softener and no additional rinse agent is dispensed into the interior of the automatic dishwasher in the course of the washing process.

21. The automatic dishwashing agent of claim 1, wherein the copolymer comprises 50% to 90% by weight of the monomer containing a sulfonic acid group.

22. The automatic dishwashing agent of claim 1, wherein the builder comprises a phosphonate.

23. The automatic dishwashing agent of claim 22, wherein the phosphonate is selected from the group consisting of aminotrimethylenephosphonic acid (ATMP) and the salts thereof, ethylenediaminetetra(methylenephosphonic acid) (EDTMP) and the salts thereof, diethylenetriaminepenta(methylenephosphonic acid) (DTPMP) and the salts thereof, 1-hydroxyethane-1,1-diphosphonic acid (HEDP) and the salts thereof, 2-phosphonobutane-1,2,4-tricarboxylic acid (PBTC) and the salts thereof, hexamethylenediaminetetra(methylenephosphonic acid) (HDTMP) and the salts thereof, and nitrilotri(methylenephosphonic acid) (NTMP) and the salts thereof.

24. The automatic dishwashing agent of claim 23, wherein the phosphonate comprises 1-hydroxyethane-1,1-diphosphonic acid (HEDP) and diethylenetriaminepenta(methylenephosphonic acid) (DTPMP).

25. The automatic dishwashing agent of claim 24, wherein the ratio by weight of HEDP to DTPMP is 20:1 to 1:20.

26. The automatic dishwashing agent of claim 22, wherein the ratio by weight of copolymer a) to the phosphonate is to 200:1 to 2:1.

27. The automatic dishwashing agent of claim 1, wherein at least a portion of the sulfonic acid groups of the copolymer are neutralized.

28. The automatic dishwashing agent of claim 1, wherein the copolymer has a molar mass of 4000 to 25,000 g/mol.

29. The automatic dishwashing agent of claim 1, wherein the builder comprises a crystalline layered silicate of the general formula $NaMSi_xO_{2x+1} \cdot y\ H_2O$, in which M represents sodium or hydrogen, x is a number from 1.9 to 22, and y is a number from 0 to 33.

30. A preformulated composition containing an automatic dishwashing agent according to claim 1, the preformulated composition being in the form of a dispensing unit having a weight of 12 to 30 g.

* * * * *